US007975904B2

(12) United States Patent
Yost

(10) Patent No.: US 7,975,904 B2
(45) Date of Patent: Jul. 12, 2011

(54) INTERMEDIATE FOR Z-FOLD BUSINESS MAILER

(75) Inventor: David Yost, Roanoke, VA (US)

(73) Assignee: Infoseal, LLC, Englewood, NJ (US)

( * ) Notice: Subject to any disclaimer, the term of this patent is extended or adjusted under 35 U.S.C. 154(b) by 1083 days.

(21) Appl. No.: 11/583,259

(22) Filed: Oct. 18, 2006

(65) Prior Publication Data

US 2007/0090173 A1 Apr. 26, 2007

Related U.S. Application Data

(60) Provisional application No. 60/728,341, filed on Oct. 19, 2005.

(51) Int. Cl.
*B65D 27/00* (2006.01)

(52) U.S. Cl. ..... 229/92.1

(58) Field of Classification Search ..... 229/92.1, 229/92.3, 313, 316

See application file for complete search history.

(56) References Cited

U.S. PATENT DOCUMENTS

| | | | |
|---|---|---|---|
| 192,131 | A | 6/1877 | Rogers |
| 202,874 | A | 4/1878 | Rogers |
| 821,723 | A | 5/1906 | Lord |
| 1,054,018 | A | 2/1913 | Mitchell |
| 1,170,434 | A | 2/1916 | Engel |
| 1,254,001 | A | 1/1918 | Clausen |
| 1,303,838 | A | 5/1919 | Callahan |
| 1,459,716 | A | 6/1923 | Blitch |
| 1,803,704 | A | 5/1931 | Hardie |
| 1,855,656 | A | 4/1932 | Voglmayer |
| 1,951,144 | A | 3/1934 | Galter |
| 2,000,763 | A | 5/1935 | Lane |
| 2,096,352 | A | 10/1937 | Semonsen |
| 2,123,903 | A | 7/1938 | Lane et al. |
| 2,128,275 | A | 8/1938 | Vogel |
| 2,260,601 | A | 10/1941 | Brenn |
| 2,503,680 | A | 4/1950 | Newman |
| 2,565,509 | A | 8/1951 | Marcin |
| 2,773,638 | A | 12/1956 | Krohn |
| 2,950,045 | A | 8/1960 | Martin |
| 3,088,754 | A | 5/1963 | Burgmer |
| 3,126,148 | A | 3/1964 | Hanson |
| 3,140,816 | A | 7/1964 | Schultz |
| 3,203,823 | A | 8/1965 | Grimes |
| 3,228,586 | A | 1/1966 | Hayes, Jr. |

(Continued)

FOREIGN PATENT DOCUMENTS

| | | |
|---|---|---|
| AU | 46812 | 8/1973 |

(Continued)

*Primary Examiner* — Jes F Pascua

(74) *Attorney, Agent, or Firm* — Mintz Levin Cohn Ferris Glovsky and Popeo, PC

(57) ABSTRACT

The invention provides an intermediate form for use in forming a business type mailer, such as a Z-fold or an eccentric Z-fold mailer. The intermediate form is configured as an individual intermediate that is supplied as a single sheet where a multiple of intermediates is provided in stacked form. Alternatively, the intermediate form is configured such that a multiple of intermediates can be provided as a continuous web or sheet and can be supplied in a roll form. The single sheet intermediate and the web or roll form intermediate are defined with pluralities of patterns of cohesive disposed at certain locations along first and second, or front and back, surfaces of the intermediates such that when provided in a stacked form or a roll form the cohesive patterns do not touch or overlap one another.

22 Claims, 7 Drawing Sheets

U.S. PATENT DOCUMENTS

| | | | | |
|---|---|---|---|---|
| 3,270,948 | A | | 9/1966 | Donovan |
| 3,270,949 | A | | 9/1966 | Hillman, II |
| 3,306,632 | A | | 2/1967 | Stahmer |
| 3,476,307 | A | | 11/1969 | Faltin et al. |
| 3,523,638 | A | | 8/1970 | Moonan |
| 3,547,343 | A | | 12/1970 | Alton 229/69 |
| 3,652,007 | A | | 3/1972 | MacDougall 229/73 |
| 3,916,051 | A | | 10/1975 | Wakeman 428/40 |
| 3,975,590 | A | | 8/1976 | Nelson 178/5 |
| 3,977,597 | A | | 8/1976 | Wise et al. 229/73 |
| 4,044,942 | A | | 8/1977 | Sherwood 229/73 |
| 4,050,361 | A | | 9/1977 | Traise 93/1 F |
| 4,063,398 | A | | 12/1977 | Huffman 53/31 |
| 4,199,630 | A | | 4/1980 | Consiglio 428/43 |
| 4,244,511 | A | | 1/1981 | Coleman 229/92.1 |
| 4,250,999 | A | | 2/1981 | Milvik 206/610 |
| 4,320,868 | A | | 3/1982 | Petersson 229/75 |
| 4,335,949 | A | | 6/1982 | Kukucka et al. 355/3 R |
| 4,376,151 | A | | 3/1983 | Parrotta 428/323 |
| 4,575,121 | A | | 3/1986 | Conti 281/2 |
| 4,706,878 | A | | 11/1987 | Lubotta et al. 229/73 |
| 4,744,508 | A | | 5/1988 | Fowler et al. 229/73 |
| 4,768,810 | A | | 9/1988 | Mertens 282/12 A |
| 4,770,337 | A | | 9/1988 | Leibe |
| 4,824,142 | A | | 4/1989 | Dossche 282/11.5 A |
| 4,896,823 | A | | 1/1990 | Taylor 229/73 |
| 4,918,128 | A | | 4/1990 | Sakai 524/450 |
| 4,928,875 | A | | 5/1990 | Hutchinson 229/92.1 |
| 4,938,505 | A | | 7/1990 | Gruttemeyer et al. 282/12 R |
| 5,085,469 | A | | 2/1992 | Castro 283/94 |
| 5,167,739 | A | | 12/1992 | Hutchinson et al. 156/64 |
| 5,172,855 | A | | 12/1992 | Coffey 229/305 |
| 5,174,491 | A | | 12/1992 | Taylor et al. 229/92.1 |
| 5,174,493 | A | * | 12/1992 | File 229/301 |
| 5,182,156 | A | | 1/1993 | Pape et al. 428/130 |
| 5,193,850 | A | | 3/1993 | Lombardo 281/2 |
| 5,201,464 | A | | 4/1993 | File 229/305 |
| 5,238,178 | A | | 8/1993 | Hutchinson et al. 229/92.1 |
| 5,253,798 | A | * | 10/1993 | Lombardo 229/92.1 |
| 5,289,972 | A | | 3/1994 | Sauerwine et al. 229/303 |
| 5,294,041 | A | | 3/1994 | Whiteside 229/69 |
| 5,314,110 | A | | 5/1994 | Lombardo 229/92.1 |
| 5,318,324 | A | | 6/1994 | Lombardo et al. 283/62 |
| 5,332,607 | A | | 7/1994 | Nakamura et al. 428/40 |
| 5,334,571 | A | | 8/1994 | Baxter 503/226 |
| 5,336,541 | A | | 8/1994 | Kobayashi 428/40 |
| 5,346,123 | A | | 9/1994 | Lombardo 229/305 |
| 5,346,430 | A | | 9/1994 | Baxter 462/2 |
| 5,350,199 | A | | 9/1994 | Young et al. 283/91 |
| 5,360,159 | A | | 11/1994 | Perriman 229/92.3 |
| 5,360,160 | A | | 11/1994 | Sauerwine et al. 229/304 |
| 5,366,145 | A | | 11/1994 | Sauerwine 229/304 |
| 5,366,410 | A | | 11/1994 | Lombardo 462/6 |
| 5,372,302 | A | | 12/1994 | Loch et al. 229/305 |
| 5,375,764 | A | | 12/1994 | Sauerwine 229/304 |
| 5,376,048 | A | | 12/1994 | Whiteside 462/6 |
| 5,402,934 | A | | 4/1995 | Sauerwine 229/303 |
| 5,409,752 | A | | 4/1995 | Juteau 428/40 |
| 5,413,532 | A | | 5/1995 | Raby 462/2 |
| 5,419,590 | A | | 5/1995 | Rothschild 283/79 |
| 5,425,500 | A | | 6/1995 | Sauerwine 229/303 |
| 5,427,851 | A | | 6/1995 | Mehta 428/356 |
| 5,437,476 | A | | 8/1995 | Hutchinson 281/151 |
| 5,458,273 | A | | 10/1995 | Schubert et al. 229/304 |
| 5,472,240 | A | | 12/1995 | Davies 283/116 |
| 5,553,774 | A | | 9/1996 | Goodno 229/303 |
| 5,566,528 | A | | 10/1996 | Lee 53/411 |
| 5,607,738 | A | | 3/1997 | Bishop 428/43 |
| 5,642,855 | A | | 7/1997 | Michlin 229/305 |
| 5,829,670 | A | * | 11/1998 | Lombardo et al. 229/92.1 |
| 5,862,978 | A | | 1/1999 | Forrest 229/70 |
| 5,893,512 | A | | 4/1999 | Diedrich 229/92.1 |
| 5,913,725 | A | | 6/1999 | Goldring 462/22 |
| 5,941,451 | A | | 8/1999 | Dexter 229/92.1 |
| 5,950,909 | A | | 9/1999 | Peterson et al. 229/92.1 |
| 5,976,014 | A | | 11/1999 | Petrick et al. 462/3 |
| 5,989,382 | A | | 11/1999 | Parker 156/292 |
| 6,003,760 | A | * | 12/1999 | Abercrombie 229/305 |
| 6,015,085 | A | | 1/2000 | Cannon et al. 229/305 |
| 6,019,280 | A | | 2/2000 | Peterson 229/305 |
| 6,039,242 | A | | 3/2000 | Tee 229/92.1 |
| 6,073,421 | A | | 6/2000 | Lee 53/206 |
| 6,092,843 | A | | 7/2000 | Peterson et al. 283/116 |
| 6,099,943 | A | | 8/2000 | Moeller et al. 428/195 |
| 6,123,255 | A | | 9/2000 | Chimera 229/305 |
| 6,126,064 | A | | 10/2000 | Hutchinson 229/92.1 |
| 6,131,802 | A | * | 10/2000 | Lombardo 229/92.1 |
| 6,138,569 | A | | 10/2000 | McCormick 101/483 |
| 6,149,518 | A | | 11/2000 | Farrow 462/27 |
| 6,179,201 | B1 | | 1/2001 | Chess 229/92.1 |
| 6,207,257 | B1 | | 3/2001 | Cummings 428/195 |
| 6,235,139 | B1 | | 5/2001 | Vichinsky, Jr. et al. 156/219 |
| 6,309,495 | B1 | | 10/2001 | Lakes 156/227 |
| 6,309,725 | B1 | * | 10/2001 | Peterson et al. 428/43 |
| 6,322,106 | B1 | | 11/2001 | Mehta et al. 281/2 |
| 6,386,442 | B2 | | 5/2002 | Mehta et al. 229/305 |
| 6,409,075 | B1 | | 6/2002 | Mehta et al. 229/92.1 |
| 6,409,592 | B1 | | 6/2002 | McCoy et al. 462/6 |
| 6,409,871 | B1 | | 6/2002 | Washburn et al. 156/256 |
| 6,573,216 | B1 | | 6/2003 | Washburn et al. 503/201 |
| 6,601,756 | B2 | | 8/2003 | Hill et al. 229/92.1 |
| 6,626,755 | B1 | | 9/2003 | Klenke et al. 462/28 |
| 6,682,099 | B1 | | 1/2004 | Laurash et al. 283/61 |
| 6,802,538 | B2 | | 10/2004 | Laurash et al. 283/61 |
| 7,219,828 | B2 | * | 5/2007 | Lombardo 229/92.1 |
| 2002/0000299 | A1 | | 1/2002 | Parker et al. 156/442.1 |
| 2002/0046803 | A1 | | 4/2002 | Parker et al. 156/227 |
| 2003/0131933 | A1 | | 7/2003 | Wilkinson et al. 156/275.1 |

FOREIGN PATENT DOCUMENTS

| | | | |
|---|---|---|---|
| BE | 0 859 071 | | 10/1977 |
| DE | 24 02 993 | A1 | 7/1975 |
| DE | 27 01 714 | C3 | 7/1978 |
| EP | 0 128 643 | A1 | 12/1984 |
| EP | 0 145 118 | A1 | 6/1985 |
| EP | 0 528 576 | A1 | 2/1993 |
| EP | 0 543 540 | A1 | 5/1993 |
| EP | 0 547 785 | A1 | 6/1993 |
| EP | 0 586 064 | A2 | 3/1994 |
| FR | 2 254 192 | | 7/1975 |
| FR | 2 338 794 | | 8/1977 |
| FR | 2 400 465 | | 3/1979 |
| GB | 638778 | | 6/1950 |
| GB | 1 357 937 | | 6/1974 |
| GB | 1 370 025 | | 10/1974 |
| GB | 1 594 798 | | 8/1981 |
| GB | 2 177 346 | A | 1/1987 |
| JP | 64-055297 | | 2/1989 |
| JP | 4-314597 | | 11/1992 |
| JP | 6-171652 | | 6/1994 |
| JP | 8-25853 | | 1/1996 |
| JP | 8-72443 | | 3/1996 |
| JP | 8-104086 | | 4/1996 |
| JP | 8-282158 | | 10/1996 |
| NL | 7609942 | | 3/1977 |
| WO | WO 85/02585 | | 6/1985 |

* cited by examiner

INTERMEDIATE FOR Z-FOLD BUSINESS MAILER

This application claims priority under 35 U.S.C. §120 to U.S. patent application Ser. No. 60/728,341, filed on Oct. 19, 2005, which is incorporated herein in its entirety by reference.

FIELD OF THE INVENTION

The invention relates to an intermediate form for use in forming a Z-fold or an eccentric Z-fold business mailer.

BACKGROUND OF THE INVENTION

Business mailers are often formed from one-piece intermediate forms that are imaged and/or printed with confidential information, as well as include checks, coupons, cards and other attachments, that are confidential or personal in nature, and require reliable sealing to ensure a secure mailer is formed for distribution through, for instance, the U.S. Postal Service. One-piece intermediate forms often include specific patterns of adhesive or cohesive that must be in a particular alignment during formation of the mailer such that certain attachments may adhere to and be contained within the mailer and to permit the sealing of the intermediate form during processing to produce a mailer. Such an intermediate form may be a sheet fed from a stack of sheets into imaging and other processing device. Alternatively, such an intermediate form may include a section of a continuous web or sheet of a multiple of intermediate forms that is supplied, for instance, as a continuous feed into imaging and other processing devices and thereafter is cut or otherwise removed from the web or sheet to form an individual intermediate form for configuration into a sealed mailer. Such a web or sheet of multiple intermediate forms is often provided in a roll configuration or form. Whether the intermediate forms are supplied as a stack of sheets or as a web or sheet in roll form, patterns of adhesive or cohesive disposed along the opposing surfaces of the intermediate forms often contact one another causing blocking during feeding operations. Therefore, placing patterns of adhesive or cohesive along one surface of intermediate forms at positions alternating from positions of patterns of adhesive or cohesive along an opposite surface of intermediate forms helps to prevent overlap or contact of patterns when the intermediate forms are stacked or are in roll form. In this manner, feeding problems associated with intermediate forms adhering to one another, or "blocking", are eliminated or minimized or reduced.

In addition, during winding or rewinding of a web or sheet of multiple intermediate forms into a roll form, pressure applied along the roll is typically substantially along tear-off strips, which are defined between side edges of an intermediate form and longitudinal lines of weakness extending from a top end edge to a bottom end edge of the intermediate form. Patterns of adhesive or cohesive are typically disposed along the tear-off strips of an intermediate form to seal the form as a business mailer and to permit an end-user to open the sealed mailer by removing or tearing the tear-off strips from the sealed mailer along the lines of weakness. As a result of winding and rewinding a web, the portions of the web along the side edges, or the tear-off strips in the roll form, are relatively thicker such that continuous winding of thicker portions onto thicker portions causes the roll form to "dish", or, in other words, to shift to the left or to the right between winds of the roll form. This result can also cause problems during feeding operations.

Also, in the event of any sideways tension applied along the roll form, such as when the roll form is on a skid during shipping, patterns of adhesive or cohesive disposed along the side edges of the intermediate forms in the roll form, so-called "pressure points", are created during winding causing the roll form to "dish" along its edges or to shift to the left or to the right.

The business form intermediates of the present invention help to eliminate or to at least minimize or reduce such problems associated with forming business mailers, as well as provide additional features and benefits.

SUMMARY OF THE INVENTION

In one aspect of the invention an intermediate form for forming a Z-fold business mailer comprises a single sheet of paper having a top end edge, a bottom end edge opposite and parallel to the top end edge, a first side edge, and a second side edge opposite and parallel to the first side edge, the edges defining a square or a rectangular configuration. In addition, the intermediate form comprises a first and a second line of weakness extending longitudinally from the top end edge to the bottom end edge and being substantially parallel to the side edges. The first line of weakness is closest to the first side edge, and a first tear-off strip is defined between the first line of weakness and the first side edge. The second line of weakness is closest to the second side edge, and a second tear-off strip is defined between the second line of weakness and the second side edge. The intermediate form also comprises a first fold line extending horizontally between the first and the second side edges to define a first panel between the bottom end edge and the first fold line, and a second fold line extending horizontally between the first and the second side edges to define a second panel between the first and the second fold lines and to define a third panel between the top end edge and the second fold line.

The intermediate form further comprises a first vertical linear pattern of cohesive disposed on a first surface of the sheet extending from the top end edge to the first fold line along the first tear-off strip of the third and second panels immediately adjacent the first side edge. Further comprising the intermediate form is a second vertical linear pattern of cohesive disposed on the first surface of the sheet extending from the top end edge to the first fold line along the second tear-off strip of the third and second panels immediately adjacent the second line of weakness. In addition, a third vertical linear pattern of cohesive is disposed on a second surface of the sheet extending from the second fold line to the bottom end edge along the second tear-off strip of the second and first panels immediately adjacent the second side edge, and a fourth vertical linear pattern of cohesive is disposed on the second surface of the sheet extending from the second fold line to the bottom end edge along the first tear-off strip of the second and first panels immediately adjacent the first line of weakness are included in the intermediate form.

Further, the intermediate form comprises a first and a second horizontal pattern of cohesive disposed along the first surface, the first horizontal pattern disposed adjacent the top end edge and the second horizontal pattern disposed above the first fold line; a third and a fourth horizontal pattern of cohesive disposed along the second surface, the third horizontal pattern disposed immediately adjacent the bottom end edge and the fourth horizontal pattern disposed below the second fold line.

The first and the second vertical linear patterns of cohesive of the intermediate form are sized and disposed along the first surface, and the third and the fourth vertical linear patterns of cohesive are sized and disposed along the second surface such that, when the sheet is stacked upon the first surface of a second identical intermediate form, the fourth and the third vertical patterns along the second surface do not touch or overlap the first and the second vertical patterns, respectively, along the first surface of the second intermediate form.

Implementations of the invention may include one or more of the following features. The first and the second vertical linear patterns of adhesive or cohesive of the intermediate form are disposed and configured such that, when the sheet is folded about the second fold line to place the third and the second panels in face-to-face relation, at least a portion of the first pattern disposed along the first tear-off strip of the third panel aligns and mates with at least a portion of the first pattern disposed along the first tear-off strip of the second panel, and at least a portion of the second pattern disposed along the second tear-off strip of the third panel aligns and mates with at least a portion of the second pattern disposed along the second tear-off strip of the second panel. The first and the second vertical linear pattern may be defined by one or more individual cohesive elements and each cohesive element has a width, along a vertical dimension of the sheet parallel to the side edges, that is greater than or equal to a width, along a vertical dimension of the sheet parallel to the side edges, of each space defined between vertically adjacent cohesive elements.

Also, alternatively or additionally, the third and the fourth vertical linear patterns are disposed and configured such that, when the sheet is folded about the first fold line to place the second and the first panels in face-to-face relation, at least a portion of the third pattern disposed along the second tear-off strip of the second panel aligns and mates with at least a portion of the third pattern disposed along the second tear-off strip of the first panel, and at least a portion of the fourth pattern disposed along the first tear-off strip of the second panel aligns and mates with at least a portion of the fourth pattern disposed along the first tear-off strip of the first panel. The third and the fourth vertical linear pattern being may be defined by one or more individual cohesive elements and each cohesive element may have a width, along a vertical dimension of the sheet parallel to the side edges, that is greater than or equal to a width, along a vertical dimension of the sheet parallel to the side edges, of each space defined between vertically adjacent cohesive elements.

The first and the second horizontal pattern of cohesive may be disposed and configured such that, when the sheet is folded about the second fold line, at least a portion of the first horizontal pattern aligns and mates with at least a portion of the second horizontal pattern. The first and the second horizontal pattern of cohesive may be defined by one or more individual cohesive elements and each cohesive element may have a width, along a horizontal dimension of the sheet parallel to the end edges, that is less than or equal to a width, along a horizontal dimension of the sheet parallel to the end edges, of each space defined between horizontally adjacent cohesive elements.

The third and the fourth horizontal pattern of cohesive may be disposed and configured such that, when the sheet is folded about the first fold line, at least a portion of the third horizontal pattern aligns and mates with at least a portion of the fourth horizontal pattern. The third and the fourth horizontal pattern of cohesive may be defined by one or more individual cohesive elements and each cohesive element may have a width, along a horizontal dimension of the sheet parallel to the end edges, that is less than or equal to a width, along a horizontal dimension of the sheet parallel to the end edges, of each space defined between horizontally adjacent cohesive elements.

The first, the second and the third panels may be defined in the sheet by the first and the second fold lines have substantially equal dimensions. Alternatively, the first and the second panel may be defined in the sheet by the first and the second fold lines may have substantially equal dimensions while the third panel may have different dimensions than the first and the second panels, or vice versa.

In another aspect of the invention an intermediate form for forming a Z-fold business mailer comprises a single sheet of paper having a top end edge, a bottom end edge opposite and parallel to the top end edge, a first side edge, and a second side edge opposite and parallel to the first side edge, the edges defining a square or a rectangular configuration, including a first and a second line of weakness extending longitudinally from the top end edge to the bottom end edge and substantially parallel to the side edges. The first line of weakness is closest to the first side edge and a first tear-off strip is defined between the first line of weakness and the first side edge, and the second line of weakness is closest to the second side edge and a second tear-off strip is defined between the second line of weakness and the second side edge. The intermediate form also comprises a first fold line extending horizontally between the first and the second side edges to define a first panel between the bottom end edge and the first fold line, and a second fold line extending horizontally between the first and the second side edges to define a second panel between the first and the second fold lines and to define a third panel between the top end edge and the second fold line;

In addition, the intermediate form comprises a first vertical linear pattern of cohesive disposed on a first surface of the sheet extending from the top end edge to the first fold line along the first tear-off strip of the third and second panels, and a second vertical linear pattern of cohesive disposed on the first surface of the sheet extending from the top end edge to the first fold line along the second tear-off strip of the third and second panels immediately the second line of weakness.

The intermediate form also comprises a first horizontal pattern of cohesive disposed along the first surface adjacent the top end edge, and a second horizontal pattern of cohesive disposed along the first surface adjacent and above the first fold line, the first and the second horizontal patterns being substantially parallel to the top and the bottom end edges.

Further, the intermediate form comprises at least a third vertical linear pattern of cohesive disposed on a second surface of the sheet extending from the second fold line to the bottom end edge along an area defined between the first and the second line of weakness.

The sheet of the intermediate form may be folded about the second fold line to dispose the third and the second panels in face-to-face relation along the first surface, and folded about the first fold line to dispose the first and the second panels in face-to-face relation along the second surface to form a Z-fold business mailer.

Various aspects of the invention may provide one or more of the following capabilities and/or advantages. An intermediate form is provided for use in forming a sealed business mailer that may be provided as one of a multiple of intermediate forms configured in a roll form designed to continuously feed intermediate forms through imaging devices and other processing equipment. In addition, the intermediate form is configured for use as a single sheet to be supplied with other intermediate forms as stacked sheets.

Placement of patterns of cohesive along a first surface of the intermediate form in alternating positions relative to positions of patterns of cohesive along a second surface can help to prevent or at least minimize or reduce contact or overlap of patterns of cohesive on the first and the second surfaces when a multiple of intermediate forms are wound in a roll form or are provided as separate sheets in a stacked form. Vertical patterns of cohesive disposed, for instance, along first and second tear-off strips, defined longitudinally along the intermediate form between sides edges and parallel longitudinal lines of weakness, can be disposed along the first surface whereby a first vertical pattern is disposed on the first surface along the first tear-off strip substantially parallel to and immediately adjacent a first side edge and a second vertical pattern is disposed on the first surface along the second tear-off strip substantially parallel to and immediately adjacent a second line of weakness that helps to define the second tear-off strip. Vertical patterns of cohesive disposed on the second surface would be located at alternate positions along the first and the second tear-off strips relative to the positions of the vertical patterns of cohesive on the first surface.

These alternate positions of the vertical patterns of cohesive disposed on the first surface along the first and the second tear-off strips relative to the vertical patterns of cohesive disposed on the second surface along the first and the second tear-off strips can help to prevent or to at least minimize problems such as "dishing" and "blocking" associated with patterns of cohesive overlapping and/or contacting one another where intermediates are provided in roll form and do not include value-added attachments, such as checks, credit cards, coupons and other attachments of value. In addition, the alternate positions of vertical cohesive patterns on the first and the second surfaces as described can help to prevent or at least minimize "blocking" when a multiple of individual intermediate forms, without value-added attachments, are provided as stacked sheets.

For intermediate forms configured to contain within the finally-formed mailer one or more value-added attachments, the alternate positions of vertical cohesive patterns on the first surface along the first and the second tear-off strips relative to the positions of vertical cohesive patterns on the second surface along the first and the second tear-off strips can cause a roll form configured from a web or sheet of a multiple of intermediate forms to "dish" in one direction, either to the left or the right, without the vertical patterns of cohesive overlapping or touching one another.

In addition, the alternate positions of vertical cohesive patterns on the first surface along the first and the second tear-off strips relative to the positions of vertical cohesive patterns on the second surface along the first and the second tear-off strips can help to alleviate feeding problems when intermediate forms are provided as sheets or when rolls are sheeted. For instance, where the intermediate form is fed to printing equipment, such as, for example, laser printers and offset presses, in a landscape orientation and feeding problems result, the intermediate form can be rotated or turned such that the side edge of the intermediate form where the vertical patterns of cohesive are disposed along the tear-off strip immediately adjacent the longitudinal line of weakness is available to provide a different surface or texture against which feeding or other mechanisms may contact to feed or process the intermediate form.

This also would help to overcome any feeding or processing problems associated with side edges of the intermediate form curving upward and/or downward, in some instances, due to patterns of cohesive. Alternating or rotating the side edge of the intermediate form to be fed into processing equipment would change the angle or orientation of one or more curves along the side edge relative to the equipment to thereby help to ease feeding or processing.

Tear-off strips of an intermediate form, which extend from a top end edge to a bottom end edge of the intermediate form and are defined between longitudinal or vertical lines of weakness and the side edges of the intermediate form, can have relatively short lengths (wherein the length of the tear-off strip is defined along a transverse dimension parallel to the end edges of the intermediate form). The relatively short length of the tear-off strips helps to increase the surface area of the intermediate form available for imaging, printing, and other uses.

Further, vertical patterns of cohesive along the tear-off strips can form a relatively secure sealed business mailer, particularly if such business mailer includes confidential or personal information or items. Such vertical patterns of cohesive can comprise individual cohesive elements having a size and a configuration that helps to reduce or to minimize the amount of room along the side edges of a sealed mailer that may be available to enable a person to pry open a portion of the sealed mailer to allow such person to read all or part of the information or other indicia, as well as to remove or damage any contents, contained therein. In this case, individual cohesive elements can have a width (wherein the width of a cohesive element is defined along a vertical dimension parallel to the side edges, or longitudinally up and down on the intermediate form) that is greater than or equal to a width of spacing between vertically adjacent cohesive elements to help to accomplish bonding of vertical patterns of cohesive along tear-off strips and to achieve a secure sealed mailer.

As mentioned, vertical patterns of cohesive disposed on a first and a second surface of the intermediate form along tear-off strips can be disposed in alternating positions or arrangements, wherein vertical patterns on the first surface are in alternating positions or arrangements relative to the positions or arrangements of vertical patterns of cohesive disposed on the second surface of the intermediate form. Such alternating patterns of cohesive thereby do not overlap or touch one another when a multiple of identical intermediate forms is configured in a roll form or is arranged as stacked sheets. For instance, a first surface of the intermediate form can include a first vertical pattern of cohesive disposed along a first tear-off strip immediately adjacent a first side edge such that, when the intermediate form is in a roll form or a stack of sheets, the first vertical pattern does not overlap or contact a vertical pattern of cohesive disposed on a second surface of the intermediate form along the first tear-off strip immediately adjacent a line of weakness that defines the first tear-off strip from a side edge. The alternate positions of the vertical patterns of cohesive along the first tear-off strip help to prevent overlap or contact of cohesive patterns with one another. Similarly, the first surface of the intermediate form can include a second vertical pattern of cohesive disposed along a second tear-off strip immediately adjacent a line of weakness such that, when the intermediate form is in a roll form or a stack of sheets, the second vertical pattern does not overlap or contact a vertical pattern of cohesive disposed on the second surface of the intermediate form along the second tear-off strip immediately adjacent a second side edge. The alternate positions of the vertical patterns of cohesive along the second tear-off strip help to prevent overlap or contact of cohesive patterns with one another. The vertical patterns of cohesive can include linear patterns comprising cohesive elements defining any of various sizes, configurations and shapes.

Further, the intermediate form can be configured as a three panel mailer and folded in a Z-fold or an eccentric Z-fold form to provide a sealed business mailer.

Another intermediate form is provided for use in forming a sealed business mailer that may be provided from a stack of intermediate forms. The intermediate mailer can be a three-panel mailer defined by a first and a second horizontal fold line traversing the intermediate form between the side edges such that the mailer includes a first or top panel, a second or middle panel, and a third or bottom panel. The first surface of the intermediate form includes first and second vertical lines of cohesive disposed along tear-off strips of two contiguous panels, such as the top and middle panel defined by the horizontal fold lines. The first and the second vertical patterns can be substantially centrally disposed along the tear-off strips between the respective lines of weakness and side edges that define the tear-off strips along each side edge of the intermediate form. Alternatively, the first vertical pattern can be located along the tear-off strip immediately adjacent a side edge and the second vertical pattern can be located along the opposing tear-off strip adjacent the line of weakness on the first surface, or vice versa. A second surface of the intermediate mailer can include one or more vertical patterns of cohesive disposed along the middle and the bottom panel on an area disposed between the lines of weakness that define the tear-off strips. The one or more vertical patterns of cohesive along the second surface permit the tear-off strips of the intermediate mailer to be reduced or relatively narrow in order to minimize the thickness of end portions of a multiple of intermediate forms when provided as stacked sheets, and to maximize the available area along the first surface for imaging, printing, or other processing.

These and other capabilities, features and/or advantages of the invention, along with the invention itself, will be more fully understood after a review of the following figures, detailed description, and claims.

DETAILED DESCRIPTION OF PREFERRED EMBODIMENTS

Figure 1:
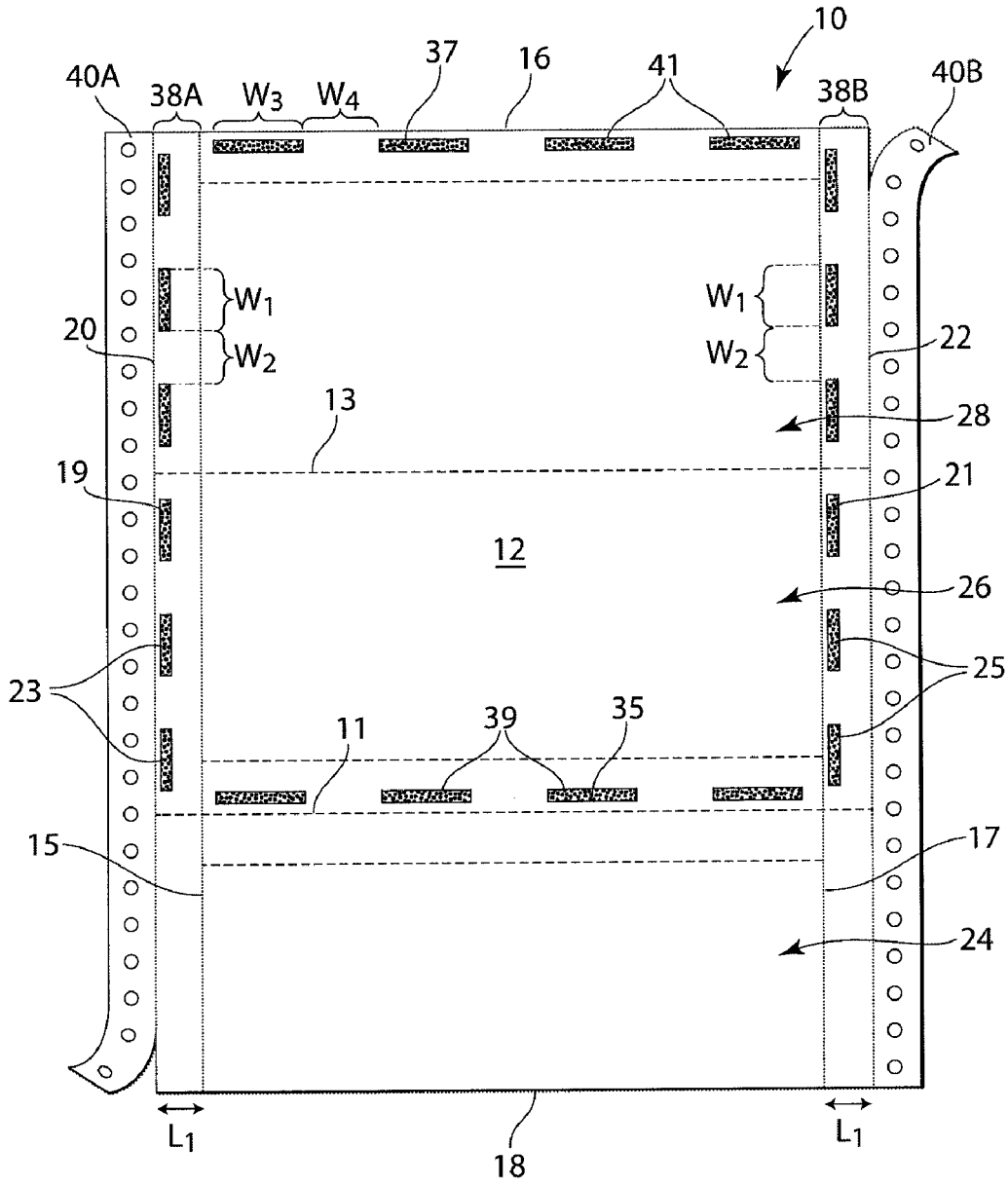
FIG. 1 is a front perspective view of an intermediate for a mailer form according to an aspect of the invention.
Figure 2:
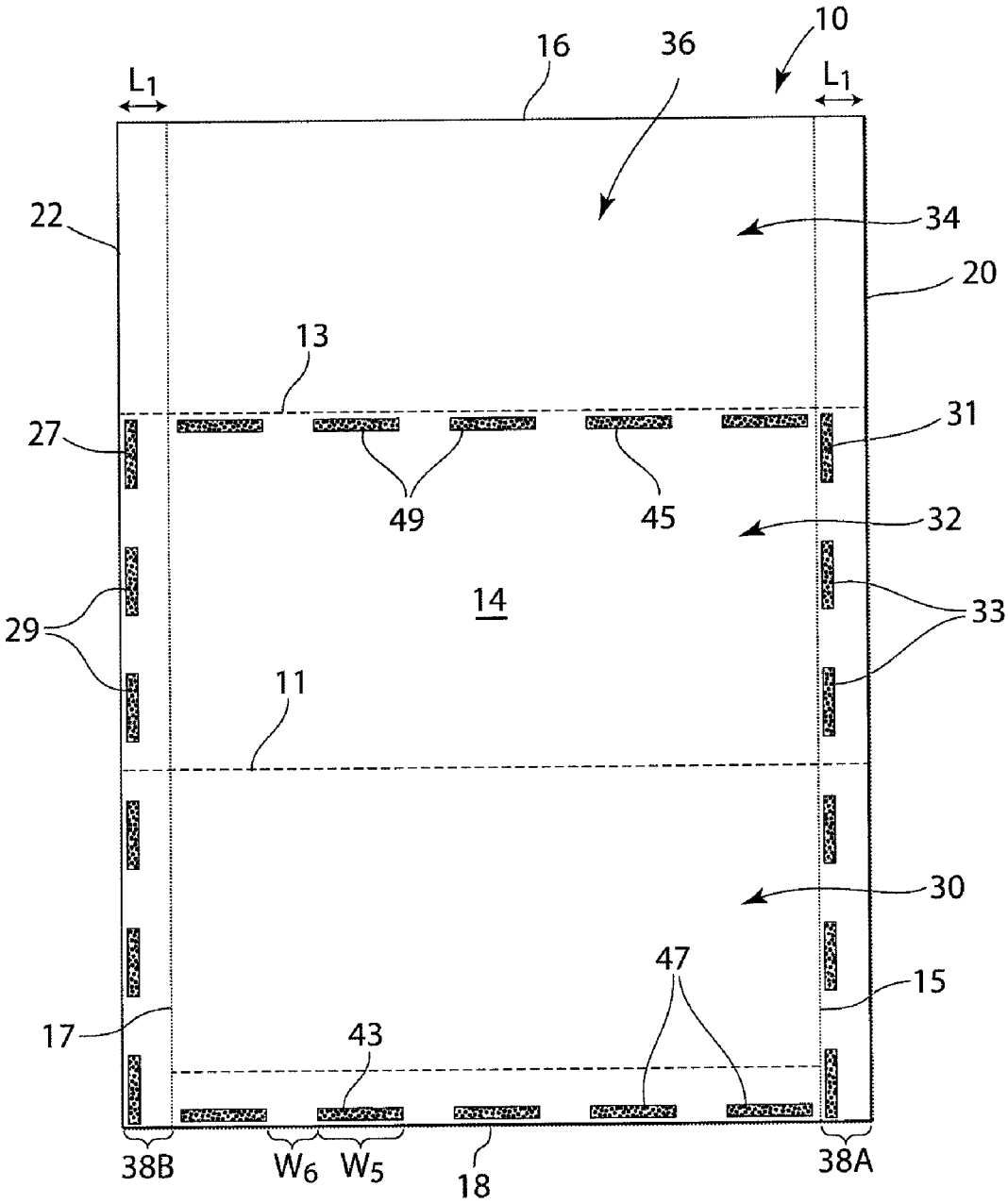
FIG. 2 is a back plan view of the intermediate shown in FIG. 1 with feed strips removed from side edges.
Figure 3:
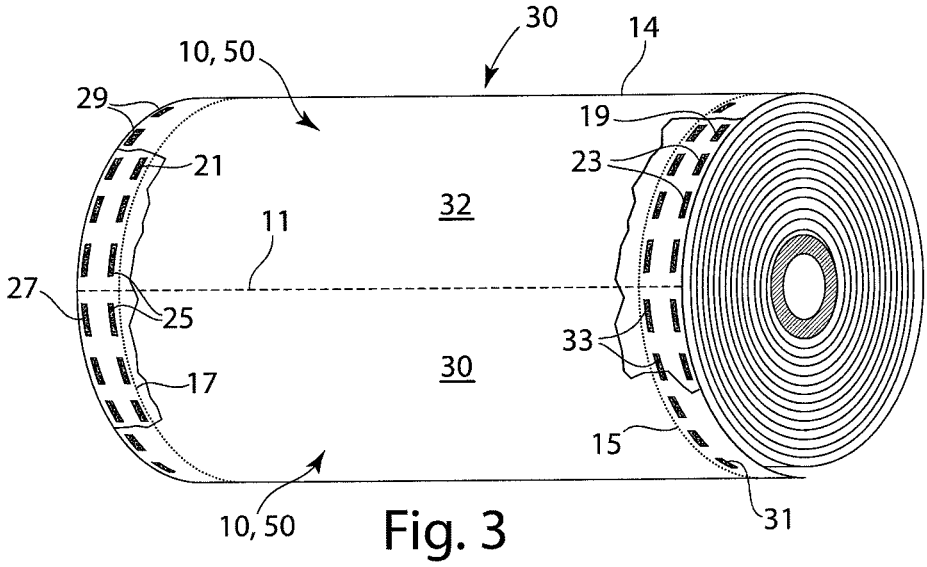
FIG. 3 is a perspective view of a web comprising a plurality of the intermediate shown in FIGS. 1 and 2 provided in a roll form.

Referring to FIGS. 1-3, in an aspect, the invention provides an intermediate 10 for use in forming a business form, such as a Z-fold or eccentric Z-fold mailer type business form. The intermediate 10 shown in FIGS. 1 and 2 illustrates an individual intermediate 10 that is formed and is supplied in a sheet or stack form. An individual intermediate 10 includes a separate sheet that may be supplied in a stack of other individual intermediates 10 and is configured for feeding separately into a printer and/or other processing equipment. Alternatively, a plurality of intermediates 10 is formed and is supplied in a roll form, as shown in FIG. 3. The plurality of intermediates 10 comprises a web 30 configured for feeding into a printer and/or other processing equipment to manufacture and otherwise process each of the plurality of intermediates 10. Pairs of adjacent intermediates 10 of the web 30 may be joined and separated by a transverse line of weakness which defines an interface of a first end edge 16 of one intermediate 10 and a second end edge 18 of an adjacent intermediate 10. Alternatively, individual intermediates 10 of the web 30 may be separated from each other by cutting or slitting an interface of the first end edge 16 of one intermediate 10 and a second end edge 18 of an adjacent intermediate 10 during manufacture or other processing of the web 30.

The intermediate 10, and each of the plurality of intermediates 10 of the web 30, is constructed of paper, plastic, plasticized paper, or any material suitable for mailing the resulting Z-fold mailer using the U.S. Postal Service. In accordance with a preferred embodiment of the invention, the intermediate 10 in sheet or stack form defines a square or rectangular configuration; similarly, in roll form, each of the plurality of intermediates 10 of the web 30 defines a square or rectangular configuration.

The preferred embodiment of the intermediate 10 according to the invention includes a first or front face 12 and a second or back face 14, and defines the first end edge 16 and the second opposite end edge 18, wherein the first and the second end edges 16 and 18 are substantially parallel to each other. The intermediate 10 further defines a first side edge 20 and a second opposite side edge 22, wherein the first and the second side edges 20 and 22 are substantially parallel to each other and are substantially perpendicular to each of the first and second end edges 16 and 18.

The intermediate 10 further defines a first and a second longitudinal line of weakness 15 and 17, e.g., a plurality of perforations, score lines, die cuts and/or other configurations. The lines of weakness 15 and 17 are disposed substantially parallel to each other and substantially parallel to and adjacent the first and second side edges 20 and 22. In the preferred embodiment, the lines of weakness 15 and 17 are substantially linear.

An area defined by the line of weakness 15 and the first side edge 20 includes a first tear-off strip 38A, and an area defined by the opposite line of weakness 17 and the second side edge 22 includes a second tear-off strip 38B. The lines of weakness 15 and 17 permit an end-user to open the intermediate 10 when the intermediate 10 is formed into a Z-fold mailer type business form by tearing the intermediate 10 along each line of weakness 15 and 17 to separate and remove each tear-off strip 38A and 38B from the intermediate 10. Each of the tear-off strips 38A and 38B defines a length $L_1$ (along a transverse dimension parallel to the end edges 16 and 18) between the first and second side edges 20 and 22 and the first and second lines of weakness 15 and 17, respectively. In the preferred embodiment, each tear-off strip 38A and 38B has a length $L_1$ in a range of from about ¼ inch to about ¾ inch, and preferably from about ⅜ inch to about ⅝ inch, and most preferably about ⅜ inch.

The intermediate 10, and each of the plurality of intermediates 10 of the web 30, may include a first substantially linear fold line 11 along the first and second face 12 and 14 which is substantially parallel to the first and second end edges 16 and 18 and is closest to the second end edge 18, as shown in FIGS. 1 and 2. The first fold line 11 may include a line of weakness, a printed line, a crease line and/or a score line in accordance with requirements of the intermediate 10 and/or the ultimate Z-fold mailer formed. The first fold line 11 defines the intermediate 10 with a first panel 24 and a second panel 26 along the first face 12, as shown in FIG. 1, and further defines the intermediate with a first panel 30 and a second panel 32 along the second face 14, as shown in FIG. 2.

In addition, the intermediate 10, and each of the plurality of intermediates 10 of the web 30, further includes along the first and second face 12 and 14 a second substantially linear fold line 13 which is substantially parallel to the first and second edge edges 16 and 18 and is closest to the first end edge 16. The second fold line 13 may include a line of weakness, a printed line, a crease line and/or a score line in accordance with requirements of the intermediate 10 and/or the ultimate Z-fold mailer formed. The second fold line 13 defines the intermediate 10 with a third panel 28 along the first face 12, as shown in FIG. 1, and a third panel 34 along the second face 14, as shown in FIG. 2.

Figure 4:
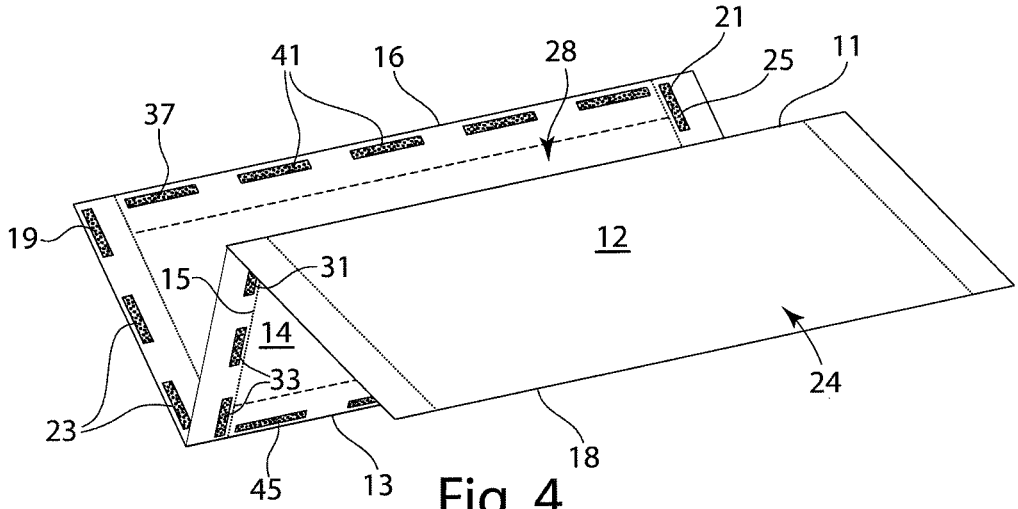
FIG. 4 is a perspective view of the intermediate shown in FIGS. 1 and 2 being folded into a Z-fold mailer type business form.

Referring to FIG. 4, the first and the second fold lines 11 and 13 are used to help to form the intermediate 10 into a mailer type business form, e.g., by Z-folding the intermediate 10 about each of the fold lines 11 and 13. More particularly, the intermediate 10 is folded about the first fold line 11 such that the first panel 30 and the second panel 32 of the second face 14 are in face-to-face relation along the second fold line 13. The intermediate 10 is further folded about the second fold line 13 such that the second panel 26 and the third panel 28 of the first face 12 are in face-to-face relation to form a Z-fold mailer type business form. Although the intermediate 10 shown in FIG. 4 illustrates a Z-fold mailer type business form, the invention anticipates the intermediate 10 may be used to form an eccentric Z-fold mailer type business form wherein the first and/or the second fold lines 11 and 13 define the intermediate 10 with at least one panel having different dimensions, e.g., length or width, than the other two panels.

Depending on the application of the intermediate 10, the printing, and the information displayed along the first or second face 12 and 14, and/or the one or more attachments that may be secured within the intermediate 10, the first and the second fold lines 11 and 13 may define the intermediate 10 according to the invention with the panels 24, 26, 28, 30, 32 and 34 of each face 12 and 14 having substantially similar dimensions, e.g., length and width. Alternatively, the first and second fold lines 11 and 13 may define the intermediate 10 with one or more panels having different dimensions. In the preferred embodiment, the first and the second fold lines 11 and 13 define the intermediate 10 with two or more of the panels having substantially similar dimensions.

The intermediate 10 also may include a feed strip 40A attached to the first tear-off strip 38A and a feed strip 40B attached to the second tear-off 38B that help to process the intermediate 10 or the web 30 during manufacturing, printing and/or any other processing of the intermediate 10 and the web 30, and during manufacturing, printing, processing and/or forming the intermediate 10 or the web 30 into one or more Z-fold mailer type business forms. At one or more phases or stages of manufacturing and/or processing, the feed strips 40A and 40B are removed, e.g., cut or slit, from the intermediate 10 and the web 30 such that the feed strips are not provided as part of the resulting Z-fold mailer type business form.

As shown in FIG. 1, in the preferred embodiment of the invention, the intermediate 10 includes a first vertical pattern 19 and a second vertical pattern 21 of pressure sensitive cohesive, e.g., a substantially linear pattern, a single linear continuous strip and/or a plurality of strips, dots and/or other geometric shapes of cohesive, disposed on the first face 12 along the first and the second tear-off strips 38A and 38B, respectively. The first vertical pattern 19 is disposed substantially parallel to and immediately adjacent the first side edge 20 such that one or more elements 23 that comprise the first vertical pattern 19 are "outbound" elements 23 and may collectively constitute an "outbound" vertical pattern 19 of pressure sensitive cohesive. An "outbound" element or vertical pattern refers to an element of or a vertical pattern of pressure sensitive cohesive disposed along the intermediate 10 or the web 30 substantially or immediately adjacent an edge, e.g., a side edge, of the intermediate 10 or web 30.

In the preferred embodiment, the "outbound" vertical pattern 19 of pressure sensitive cohesive is substantially linear and is disposed immediately adjacent the first side edge 20 of the intermediate 10 or the web 30.

The second vertical pattern 21 is disposed substantially parallel to and immediately adjacent the second line of weakness 17 such that one or more elements 25 that comprise the second vertical pattern 21 are "inbound" elements 25 and may collectively constitute an "inbound" vertical pattern 21 of pressure sensitive cohesive. An "inbound" element or vertical pattern refers to an element of or a vertical pattern of pressure sensitive cohesive disposed along the intermediate 10 or the web 30 substantially or immediately adjacent a vertical line of weakness, e.g., the second vertical line of weakness 17, of the intermediate 10 or web 30.

In the preferred embodiment, the "inbound" vertical pattern 21 of pressure sensitive cohesive is substantially linear and is disposed immediately adjacent the second vertical line of weakness 17 of the intermediate 10 or the web 30.

As shown in FIG. 1, the outbound elements 23 of the first vertical pattern 19 are disposed along the tear-off strip 38A of the second and third panels 26 and 28 of the first face 12. Each element 23 disposed along the tear-off strip 38A of the second panel 26 is disposed and/or sized to mate with a corresponding element 23 disposed along the tear-off strip 38A of the third panel 28 when the intermediate 10 is folded about the second fold line 13 to place the second panel 26 and the third panel 28 in face-to-face relation. The mated elements 23 may be adhered or bonded together during processing of the intermediate 10.

Similarly, the inbound elements 25 of the second vertical pattern 21 are disposed along the tear-off strip 38B of the second and third panels 26 and 28 of the first face 12. Each element 25 disposed along the tear-off strip 38B of the second panel 26 is disposed and/or sized to mate with a corresponding element 25 disposed along the tear-off strip 38B of the third panel when the intermediate 10 is folded about the second fold line 13 to place the second panel 26 and the third panel 28 in face-to-face relation. The mated elements 25 may be adhered or bonded together during processing of the intermediate 10.

As shown in FIG. 2, in the preferred embodiment of the intermediate 10 according to the invention, a first vertical pattern 27 and a second vertical pattern 31 of pressure sensitive cohesive, e.g., a substantially linear pattern, a single continuous strip and/or a plurality of strips, dots and/or other geometric shapes of cohesive, are disposed on the second face 14 along the second and the first tear-off strips 38B and 38A, respectively. The first vertical pattern 27 is disposed substantially parallel to and immediately adjacent the second side edge 22 along the second face 14 such that one or more elements 29 that comprise the first vertical pattern 27 are "outbound" elements 29 and may collectively constitute an "outbound" vertical pattern 27 of pressure sensitive cohesive along the second face 14. In the preferred embodiment, the first vertical pattern 27 of pressure sensitive cohesive is substantially linear.

In addition, the second vertical pattern 31 is disposed substantially parallel to and immediately adjacent the first line of weakness 15 along the second face 14 such that one or more elements 33 that comprise the second vertical pattern 31 are "inbound" elements 33 and may collectively constitute an "inbound" vertical pattern 31 of pressure sensitive cohesive along the second face 14. In the preferred embodiment, the second vertical pattern 31 of pressure sensitive cohesive is substantially linear.

As shown in FIG. 2, the outbound elements 29 of the first vertical pattern 27 are disposed along the tear-off strip 38B of the first and second panels 30 and 32 of the second face 14. Each element 29 disposed along the tear-off strip 38B of the first panel 30 is disposed and/or sized to mate with a corresponding element 29 disposed along the tear-off strip 38B of the second panel 32 when the intermediate 10 is folded about the first fold line 11 to place the first panel 30 and the second panel 32 in face-to-face relation. The mated elements 29 may be adhered or bonded together during processing of the intermediate 10.

Similarly, the inbound elements 33 of the second vertical pattern 31 are disposed along the tear-off strip 38A of the first and second panels 30 and 32 of the second face 14. Each element 33 disposed along the tear-off strip 38A of the first panel 30 is disposed and/or sized to mate with a corresponding element 33 disposed along the tear-off strip 38A of the second panel 32 when the intermediate 10 is folded about the first fold line 11 to place the first panel 20 and the second panel 32 in face-to-face relation. The mated elements 33 may be adhered or bonded together during processing of the intermediate 10.

Figure 5:
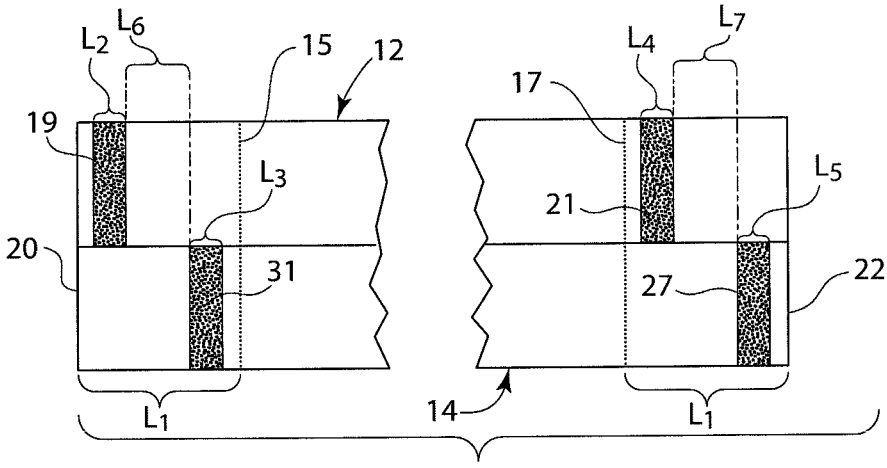
FIG. 5 is a cross-sectional view of the intermediate shown in FIGS. 1 and 2 in a stack or roll form.

Referring to FIG. 5, and with further reference to FIGS. 1-3, in the preferred embodiment of the invention, the first vertical pattern 19 and the second vertical pattern 21 of pressure sensitive cohesive on the first face 12 are disposed and sized such that when the intermediate 10 or the web 30 is formed into or is supplied as a roll form, the first vertical pattern 19 and the second vertical pattern 21 along the first face 12 do not touch or overlap with the second vertical pattern 31 and the first vertical pattern 27 along the second face 14, respectively. Similarly, the first and the second vertical patterns 27 and 31 along the second face 14 are disposed and sized such that when the intermediate 10 or the web 30 is formed into or is supplied as a roll form, the first and second vertical patterns 27 and 31 along the second face 14 do not touch or overlap with the second and first vertical patterns 21 and 19 along the first face 12, respectively.

The positioning and size of the elements 23, 25, 29, 31 comprising each of the first and the second vertical patterns 19 and 21 along the first face 12 and each of the first and the second vertical patterns 27 and 31 along the second face 14, respectively, permit the intermediate 10 or the web 30 to be formed into and supplied as a roll form without the vertical patterns 19 and 21 along the first face 12 touching or overlapping the vertical patterns 27 and 31 along the second face 14.

More particularly, the positioning and size, e.g., width, length and/or shape, of each of the one or more elements 23 of the first vertical pattern 19 along the first face 12 help to prevent each element 23 from touching or overlapping any of the one or more elements 33 of the second vertical pattern 31 along the second face 14. Similarly, the positioning and size, e.g., width, length and/or shape, of each of the one or more elements 25 of the second vertical pattern 21 along the first face 12 help to prevent each element 25 from touching or overlapping any of the one or more elements 29 of the first vertical pattern 27 along the second face 14.

As shown in FIG. 5, the vertical patterns 19 and 21 of pressure sensitive cohesive on the first face 12 do not touch or overlap with the vertical patterns 31 and 27 of pressure sensitive cohesive on the second face 14, respectively, to thereby allow a plurality of intermediates 10 to be formed into and supplied as the web 30 in roll form.

With further reference to FIGS. 1-3 and FIG. 5, in the preferred embodiment of the invention each outbound element 23 of the first vertical pattern 19 along the first face 12 defines a length $L_2$ (along a transverse dimension parallel to the first and second end edges 16 and 18) less than the length $L_1$ of the tear-off 38A.

In addition, in the preferred embodiment each inbound element 33 of the second vertical pattern 31 along the second face 14 defines a length $L_3$ (along a transverse dimension parallel to the first and second end edges 16 and 18) less than the length $L_1$ of the tear-off strip 38A.

The length $L_2$ of each outbound element of the first vertical pattern 19 along the first face 12 and the length $L_3$ of each inbound element of the second vertical pattern 31 along the second face 14 is within a range such that a sum of the lengths $L_2$ and $L_3$ is less than or equal to the length $L_1$ of the respective tear-off strip 38A along which the elements 23 and 33 are disposed. Along with the positioning of the outbound and inbound elements 23 and 33 of the first and the second vertical patterns 19 and 31 along the tear-off strip 38A, the length $L_2$ and $L_3$ of the individual elements 23 and 33 helps to avoid or prevent the outbound vertical pattern 19 along the first face 12 from touching or overlapping the inbound vertical pattern 31 along the second face 14 when the web 30 is formed or is supplied in a roll or sheet form.

In the preferred embodiment, the length $L_2$ and $L_3$ of each element 23 and 33 of the respective outbound and inbound vertical patterns 19 and 31 is within a range of from about 1/16 inch to about 1/2 inch, and preferably from about 1/16 inch to about 1/4 inch, and most preferably about 1/8 inch.

Still referring to FIGS. 1-3 and FIG. 5, in the preferred embodiment each inbound element 25 of the second vertical pattern 21 along the first face 12 defines a length $L_4$ (along a transverse dimension parallel to the first and second end edges 16 and 18) less than the length $L_1$ of the tear-off strip 38B.

In addition, in the preferred embodiment each outbound element 29 of the first vertical pattern 27 along the second face 14 defines a length $L_5$ (along a transverse dimension parallel to the first and second end edges 16 and 18) less than the length $L_1$ of each tear-off strip 38B.

The length $L_4$ and $L_5$ of each inbound element 25 and each outbound element 29 of the respective second and first vertical patterns 21 and 27 is within a range such that a sum of the lengths $L_4$ and $L_5$ is less than or equal to the $L_1$ of the tear-off strip 38B. Along with the positioning of the inbound and outbound elements 25 and 29 along the tear-off strip 38B, the length $L_4$ and $L_5$ of the inbound and outbound elements 25 and 29 helps to prevent the inbound vertical pattern 21 along the first face 12 from touching or overlapping the outbound vertical pattern 27 along the second face 14 when the web 30 is formed or is supplied in a roll or sheet form.

In the preferred embodiment, the length $L_4$ and $L_5$ of each element 25 and 29, respectively, is within a range of from about 1/16 inch to about 1/2 inch, and preferably from about 1/16 inch to about 1/4 inch, and most preferably about 1/8 inch.

With further reference to FIG. 5, in the preferred embodiment according to the invention the one or more elements 23 of the first vertical pattern 19 along the first face 12 and the one or more elements 33 of the second vertical pattern 31 along the second face 14 are positioned and/or sized such that when the intermediate 10 or the web 30 is formed or is supplied in a roll or sheet form, the elements 23 and 33 define spacing therebetween having a length $L_6$ (along a transverse dimension parallel to the first and second end edges 16 and 18) that extends longitudinally along the tear-off strip 38A.

In addition, the one or more elements 25 of the second vertical pattern 21 along the first face 12 and the one or more elements 29 of the first vertical pattern 27 along the second face 14 are positioned and/or sized such that when the intermediate 10 or the web 30 is formed or is supplied in a roll or sheet form, the elements 25 and 29 define spacing therebetween having a length $L_7$ (along a transverse dimension parallel to the first and second end edges 16 and 18) that extends longitudinally along the tear-off strip 38B.

The length $L_6$ of the spacing defined by the elements 23 and 33 of the respective outbound and inbound vertical patterns 19 and 31 and the length $L_7$ of the spacing defined by the elements 25 and 29 of the respective inbound and outbound vertical patterns 21 and 27 further help to ensure that the vertical patterns 19 and 21 disposed along the first face 12 do not touch or overlap the vertical patterns 31 and 27 disposed along the second face 14, respectively.

In the preferred embodiment, the lengths $L_6$ and $L_7$ of the spacing are each within a range of about 1/32 inch to about 1/2 inch, and preferably from about 1/32 inch to about 1/4 inch, and most preferably about 1/8 inch.

As shown in FIG. 3, and with further reference to FIG. 5, the plurality of intermediates 10 may be transported, stored and supplied as the web 30 in roll form for processing without the elements 23, 25, 29 and 33 of the vertical patterns 19, 21, 27 and 31 of pressure sensitive cohesive touching or overlapping any of the other elements 23, 25, 29 and 33 to help to avoid adhering or bonding of any of the elements to one another and to thereby help to avoid compromising the integrity of the web 30 and of each intermediate 10. In addition, problems associated with printing and/or other processing of the intermediate 10 or the web 30 may be minimized or avoided.

As mentioned, at least one benefit or advantage of the positioning and/or size of the one or more elements 23, 25, 29 and 33 comprising the vertical patterns 19, 21, 27 and 31, respectively, is to help to avoid touching or overlapping with any of the other elements 23, 25, 29 and 33 in roll form. In addition, at least one further benefit or advantage of the positioning and/or size of the one or more elements 23, 25, 29 and 33 comprising the vertical patterns 19, 21, 27 and 31 is, after sheeting, an ability to alter or rotate the intermediate 10 to help to overcome any problems associated with feeding and/or other processing equipment and mechanisms, such as laser printers and sheet-fed offset presses, during manufacturing and/or other processing of the intermediate 10. For instance, if a feeding issue or problem occurs along the first side edge 20 of the intermediate 10, or, in other words, along any of the "outbound" elements 23 and 29 of the vertical patterns 19 and 27 of pressure sensitive cohesive disposed along the first and the second faces 12 and 14, respectively, the intermediate 10 may be rotated such that the second side edge 22 may be used to provide a different texture or textured surface against any feeding and/or other equipment or mechanisms to thereby help to overcome the feeding issue or problem.

With further reference to FIGS. 1 and 2, a width $W_1$ of one or more of the elements 23, 25, 29, 33 (along a vertical dimension substantially parallel to the side edges 20 and 22 or, in other words, longitudinally up and down) further help to increase the security of the intermediate 10 when the intermediate 10 is formed into a Z-fold mailer type business form. The width $W_1$ of one or more of the elements 23, 25, 29 and 33 may be substantially equal such that longitudinally adjacent pairs of elements 23, 25, 29 and 33 define spacing therebetween having a width $W_2$ (along a vertical dimension substantially parallel to the side edges 20 and 22 or, in other words, longitudinally up and down) that is substantially equal.

In the preferred embodiment, the width $W_1$ of the elements 23, 25, 29 and 33 is greater than the width $W_2$ of the spacing defined between longitudinally adjacent pairs of elements 23, 25, 29 and 33. In this case, the width $W_1$ of the elements 23, 25, 29 and 33 and/or the width $W_2$ of the spacing help the adhering/bonding of the respective tear-off strips 38A and 38B. The resulting Z-fold mailer type business form formed from the intermediate 10 has a relatively reduced or minimized amount of room along the side edges 20 and 22 available to enable one to pry open, e.g., manually, a portion of either side edge 20 and 22 to allow one to read all or part of the internal information provided within the formed mailer such as, for instance, information displayed on one or more panels and/or on one or more attachments, e.g., checks, coupons and similar value-added features, contained within the mailer. The vertical patterns of cohesive 19, 25, 27 and 31 of the intermediate 10 thereby help to enhance or maximize the security of the resulting Z-fold mailer and also help to ensure that the internal information within the mailer remains secure and confidential until the mailer is opened by an intended end-user.

With further reference to FIGS. 1 and 2, the intermediate 10, and each of the plurality of intermediates 10 of the web 30, further includes a first horizontal pattern 37 of pressure sensitive cohesive disposed along the first face 12 substantially parallel to the first and second end edges 16 and 18 and adjacent the first end edge 16. In addition, a second horizontal pattern 35 of pressure sensitive cohesive is disposed along the first face 12 substantially parallel to the first and second end edges 16 and 18 and adjacent and above the first fold line 11. Each of the first horizontal pattern 37 and the second horizontal pattern 35 may include, for instance, a substantially linear pattern and/or a plurality of strips, dots and/or other geometric shapes of cohesive. In the preferred embodiment, the first and the second horizontal patterns 37 and 35 include substantially linear patterns.

Each of the one or more elements 41 and 39 that collectively comprise the first horizontal pattern 37 and the second horizontal pattern 39, respectively, are positioned and/or sized, e.g., as defined by a length, width and/or shape, such that when the intermediate 10 is folded about the second fold line 13 to place the third panel 28 and the second panel 26 in face-to-face relation, each element 41 of the first horizontal pattern 37 mates with a corresponding element 39 of the second horizontal pattern 35 to permit the mated elements 39 and 41 to be adhered or bonded during processing of the intermediate 10 and to thereby adhere or bond the second and the third panels 26 and 28 of the first face 12 together.

Similarly, along the second face of the intermediate 10, and each of the plurality of intermediates 10 of the web 30, a first horizontal pattern 43 of pressure sensitive cohesive is disposed along the second face 14 substantially parallel to the first and second end edges 16 and 18 and adjacent the second end edge 18. In addition, a second horizontal pattern 45 of pressure sensitive cohesive is disposed along the second face 14 substantially parallel to the first and second end edges 16 and 18 and adjacent and below the second fold line 13. Each of the first horizontal pattern 43 and the second horizontal pattern 45 may include, for instance, a substantially linear pattern and/or a plurality of strips, dots or other geometric shapes of cohesive.

Each of the one or more elements 47 and 45 that collectively comprise the first horizontal pattern 43 and the second horizontal pattern 49, respectively, are positioned and/or sized, e.g., as defined by length, width and/or shape, such that when the intermediate 10 is folded about the first fold line 11 to place the first panel 30 and the second panel 32 in face-to-face relation, each element 47 of the first horizontal pattern 43 mates with a corresponding element 49 of the second horizontal pattern 45 to permit the mated elements 45 and 45 to be adhered or bonded during processing of the intermediate 10 and to thereby adhere or bond the first and the second panels 30 and 32 of the second face 14 together to form the Z-fold mailer type business form.

As shown in FIG. 1, a width $W_3$ (in a horizontal dimension parallel to the first and the second end edges 16 and 18) of each element 39 and 41 of the second horizontal pattern 35 and the first horizontal pattern 37, respectively, along the first face 12 is greater than a width $W_4$ (in a horizontal dimension parallel to the first and the second end edges 16 and 18) of spacing defined between two horizontally adjacent pairs of elements 39 and 41.

In addition, the width $W_3$ of one or more elements 39 and 41 may be substantially the same width $W_3$ as other elements 39 and 41 of the respective horizontal patterns 35 and 37, or may have different widths $W_3$ from one or more of the other elements 39 and 41.

In the preferred embodiment of the invention, each of the elements 39 and 41 of the respective horizontal patterns 35 and 37 has a width $W_3$ that is greater than a width $W_4$ of the spacing defined between horizontally adjacent pairs of elements 39 and 41. The width $W_3$ of the elements 39 and 41 helps to dispose a larger portion of cohesive along the first face 12, for instance, relative to one of or both of the horizontal patterns of cohesive 43 and 45 disposed along the second face 14, to thereby help to increase or maximize the security of the first face 12, if the first face 12 constitutes an imaged face of the intermediate 10. In particular, as mentioned above, security of the intermediate 10 is desirable if the imaged first face 12 includes personal and/or confidential information.

Similarly, as shown in FIG. 2, a width $W_5$ (in a horizontal dimension parallel to the first and the second end edges 16 and 18) of one or more elements 47 of the first horizontal pattern 43 and/or one or more elements 49 of the second horizontal pattern 45 along the second face 14 is less than a width $W_6$ (in a horizontal dimension parallel to the first and the second end edges 16 and 18) of spacing defined between two horizontally adjacent pairs of elements 47 and 49.

In addition, the width $W_5$ of one or more elements 47 and 49 of the first 43 and/or the second 45 horizontal cohesive patterns may be substantially the same width Ws as other elements 47 and 49 of the respective horizontal patterns 43 and 45, or may have different widths $W_5$ from one or more of the other elements 47 and 49.

In the preferred embodiment of the invention, each element 47 of the first horizontal pattern 43 has a width $W_5$ that is less than a width $W_6$ of the spacing between horizontally adjacent pairs of elements 47. The width $W_5$ of the elements 47 is minimized in order to help to reduce the amount of cohesive disposed horizontally along the second face 14 of the intermediate 10 and to help to hold the intermediate 10 together during formation of the Z-fold mailer and processing of the mailer through the mail stream. In an alternative embodiment of the invention, one or more elements 47 of the first horizontal pattern 43 and/or one or more elements 49 of the second horizontal pattern 45 have a width $W_5$ that is less than a width $W_6$ of the spacing between horizontally adjacent pairs of elements 47 and 49.

As shown in FIGS. 1 and 2, the first and the second vertical patterns of cohesive 19 and 21 are disposed on the first face 12 along the second and the third panels 26 and 28 in order to help to maximize the amount of surface area, e.g., of at least the second panel 26 and the third panel 28, of the first face 12 that is available for imaging, printing and/or other processing. In the preferred embodiment of the invention, the intermediate 10 is configured to provide the first face 12 as the surface on which confidential information is simplex imaged in order to orient all such confidential information towards an interior of the intermediate 10 when the intermediate 10 is formed into a Z-fold mailer type business form.

The invention is not limited to the position of the first and the second vertical patterns 19 and 21 and envisions that the first and the second vertical patterns 19 and 21 of pressure sensitive cohesive 19 and 21 may be disposed on the first face 12 along the tear-off strips 38A and 38B of the first and the second panels 24 and 26. It follows that the invention also anticipates that the position of the first and the second vertical patterns 29 and 31 of pressure sensitive cohesive on the second face 14 may be disposed along the tear-off strips 38A and 38B of the second and the third panels 32 and 34.

Figure 6A:
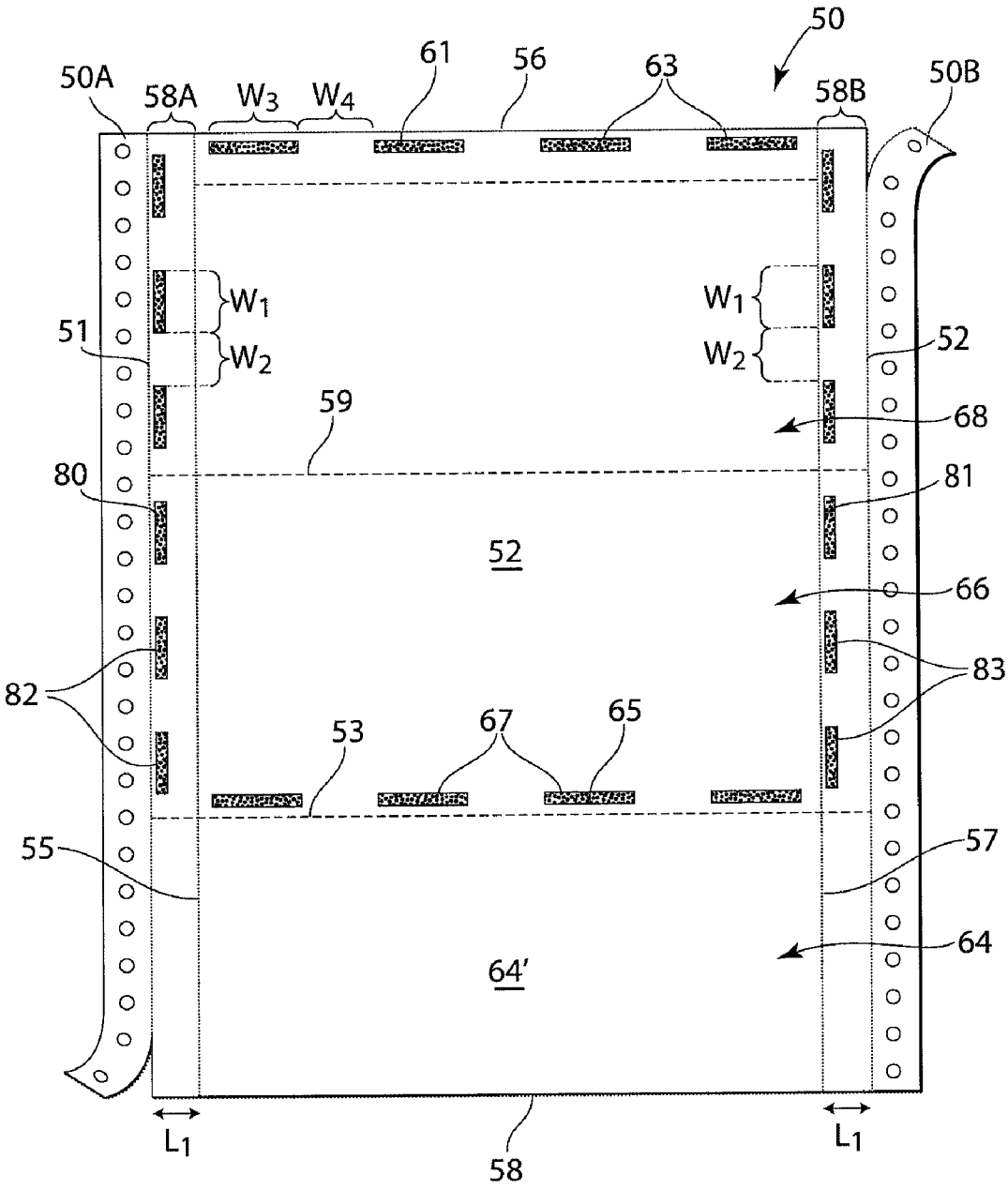
FIG. 6A is a front perspective view of an intermediate for a mailer form according to another aspect of the invention.
Figure 6B:
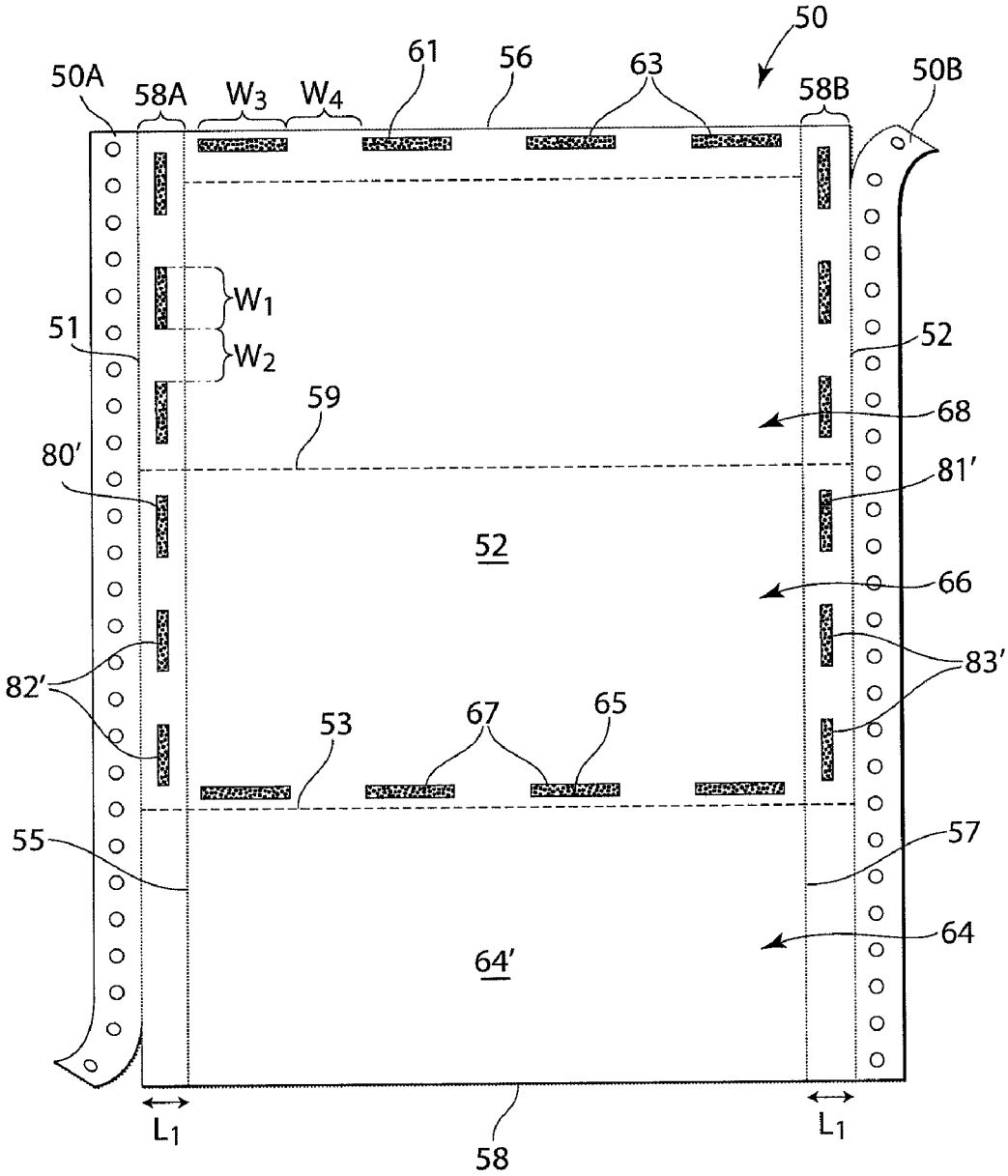
FIG. 6B is a front perspective view of an intermediate for a mailer form according to a further aspect of the invention.
Figure 7:
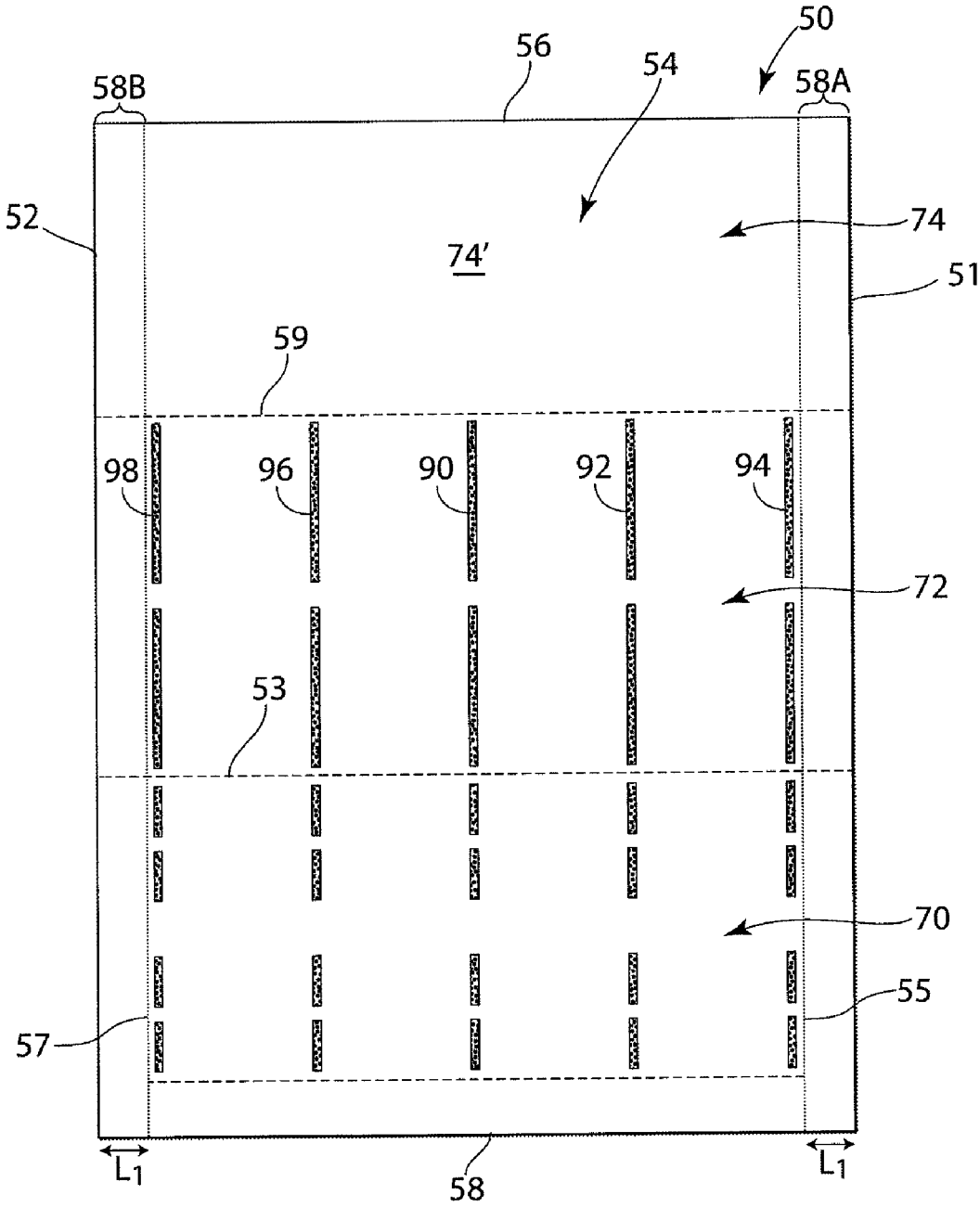
FIG. 7 is a back plan view of the intermediate shown in FIG. 6 with feed strips removed from side edges.

Referring to FIGS. 6A-6B and FIG. 7, in another aspect, the invention provides an intermediate 50 for use in forming a business form, such as a Z-fold or an eccentric Z-fold mailer type business form. The intermediate 50 shown in FIGS. 6A-6B and FIG. 7 illustrates an individual intermediate 50 that is formed and is supplied in a sheet or stack form. An individual intermediate 50 includes a separate sheet that may be supplied in a stack of other individual intermediates 50 and is configured for feeding separately into a printer and/or other processing equipment. Alternatively, a plurality of intermediates 50 is formed and is supplied in a roll form as the web 30 similar to that shown in FIG. 3. A plurality of intermediates 50 comprises the web 30 that is formed and is provided in roll form, as shown in FIG. 3, and is configured for feeding into a printer and/or other processing equipment to manufacture and otherwise process each of the plurality of intermediates 50.

Pairs of adjacent intermediates 50 of the web 30 may be joined and separated by a transverse line of weakness which defines an interface of a first end edge 56 of one intermediate 50 and a second end edge 58 of an adjacent intermediate 50. Alternatively, individual intermediates 50 of the web 30 may be separated from each other by cutting or slitting an interface of the first end edge 56 of one intermediate 50 and a second end edge 58 of an adjacent intermediate 50 during manufacture or other processing of the web 30.

The intermediate 50, and each of the plurality of intermediates 50 of the web 30, is constructed of paper, plastic, plasticized paper, or any material suitable for mailing the resulting Z-fold mailer using the U.S. Postal Service. In accordance with a preferred embodiment of the invention, the intermediate 50 in sheet or stack form defines a square or rectangular configuration; similarly, in roll form, each of the plurality of intermediates 50 of the web 30 defines a square or rectangular configuration.

As shown in FIGS. 6A-6B and FIG. 7, the preferred embodiment of the intermediate 50 according to the invention includes a first or front face 52 and a second or back face 54, and defines the first end edge 56 and the second opposite end edge 58, wherein the first and the second end edges 56 and 58 are substantially parallel to each other. The intermediate 50 further defines a first side edge 51 and a second opposite side edge 52, wherein the first and the second side edges 51 and 52 are substantially parallel to each other and are substantially perpendicular to each of the first and second end edges 56 and 58.

The intermediate 50 further defines a first and a second longitudinal line of weakness 55 and 57, e.g., a plurality of perforations, score lines, die cuts and/or other configurations. The lines of weakness 55 and 57 are disposed substantially parallel to each other and substantially parallel to and adjacent the first and second side edges 51 and 52. In the preferred embodiment, the lines of weakness 55 and 57 are substantially linear.

An area defined by the line of weakness 55 and the first side edge 51 includes a first tear-off strip 58A, and an area defined by the opposite line of weakness 57 and the second side edge 52 includes a second tear-off strip 58B. The lines of weakness 55 and 57 permit an end-user to open the intermediate 50 when the intermediate 50 is formed into a Z-fold mailer type business form by tearing the intermediate 50 along each line of weakness 55 and 57 to separate and remove each tear-off strip 58A and 58B from the intermediate 50. Each of the tear-off strips 58A and 58B defines a length $L_1$ (along a transverse dimension parallel to the end edges 56 and 58) between the first and second side edges 51 and 52 and the first and second lines of weakness 55 and 57, respectively.

In the preferred embodiment, each tear-off strip 58A and 58B has a length $L_1$ in a range of from about ⅛ inch to about ¾ inch, and preferably about ¼ inch to about ⅝ inch, and most preferably about ⅜ inch.

The intermediate 50, and each of the plurality of intermediates 50 of the web 30, includes a first substantially linear fold line 53 along the first and second face 52 and 54 which is substantially parallel to the first and second end edges 56 and 58 and is closest to the second end edge 58, as shown in FIGS. 6A-6B and FIG. 7. The first fold line 53 may include a line of weakness, a printed line, a crease line and/or a score line in accordance with requirements of the intermediate 50 and/or the ultimate Z-fold mailer formed. The first fold line 53 defines the intermediate 50 with a first panel 64 and a second panel 66 along the first face 52, as shown in FIG. 6A-6B, and further defines the intermediate 50 with a first panel 70 and a second panel 72 along the second face 54, as shown in FIG. 7.

In addition, the intermediate 50, and each of the plurality of intermediates 50 of the web 30, further includes along the first and second face 52 and 54 a second substantially linear fold line 59 which is substantially parallel to the first and second edge edges 56 and 58 and is closest to the first end edge 56. The second fold line 59 may include a line of weakness, a printed line, a crease line and/or a score line in accordance with requirements of the intermediate 10 and/or the ultimate Z-fold mailer formed. The second fold line 59 defines the intermediate 50 with a third panel 68 along the first face 52, as shown in FIG. 1, and a third panel 74 along the second face 54, as shown in FIG. 7.

With further reference to FIGS. 6A-6B and FIG. 7, the first and the second fold lines 53 and 59 are used to help to form the intermediate 50 into a mailer type business form, e.g., by Z-folding the intermediate 10 about each of the fold lines 53 and 59. More particularly, the intermediate 50 is folded about the second fold line 59 such that the second panel 66 and the third panel 68 of the first face 52 are in face-to-face relation. The intermediate 10 is further folded about the first fold line 53 such that the first panel 70 and the second panel 72 of the second face 54 are in face-to-face relation to thereby form a Z-fold mailer type business form.

Although the intermediate 50 shown in FIGS. 6A-6B and FIG. 7 illustrates an intermediate 50 that can be folded into a Z-fold mailer type business form, the invention anticipates the intermediate 50 may be used to form an eccentric Z-fold mailer type business form wherein the first and/or the second fold lines 53 and 59 define the intermediate 50 with at least one panel having different dimensions, e.g., length and width, than the other two panels.

The intermediate 50 also may include a feed strip 50A attached to the first tear-off strip 58A and a feed strip 50B attached to the second tear-off 58B that help to process the intermediate 50 or the web 30 during manufacturing, printing and/or any other processing of the intermediate 10 and the web 30, and during manufacturing, printing, processing and/or forming the intermediate 10 or the web 30 into one or more Z-fold mailer type business forms. At one or more phases or stages of manufacturing and/or processing, the feed strips 50A and 50B are removed, e.g., cut or slit, from the intermediate 50 and the web 30 and are not provided with the resulting Z-fold mailer type business form.

As shown in FIG. 6A, the intermediate 50 includes a first vertical pattern 80 and a second vertical pattern 81 of pressure sensitive cohesive, e.g., a substantially linear pattern, a single continuous strip and/or a plurality of strips, dots and/or other geometric shapes of cohesive, disposed on the first face 52 along the first and the second tear-off strips 58A and 58B, respectively.

In one embodiment of the invention, the first vertical pattern 80 is disposed along the first tear-off strip 58A substantially parallel to the first and second side edges 51 and 52 and the first line of weakness 55. As shown in FIG. 6A, the one or more elements 82 of the first vertical pattern 80 are "outbound" elements 82 disposed immediately adjacent the first side edge 51 and collectively constitute an "outbound" vertical pattern 80 of pressure sensitive. The "outbound" vertical pattern 80 of pressure sensitive cohesive is preferably substantially linear.

In an alternative embodiment of the invention shown in FIG. 6B, one or more elements 82' of a first vertical pattern 80' are disposed substantially centrally along the tear-off strip 58A between the first side edge 51 and the first line of weakness 55 and parallel to the first and second side edges 51 and 52.

In a further alternative embodiment, one or more elements 82' of the first vertical pattern 80' are inbound elements 82' disposed parallel to the first and second side edges 51 and 52 and immediately adjacent the first line of weakness 55.

Similarly, in the embodiment of the invention shown in FIG. 6A, the second vertical pattern 81 is disposed substantially parallel to the first and second side edges 51 and 52 and immediately adjacent the second line of weakness 57 such that one or more elements 83 are "inbound" elements 83 and collectively constitute an "inbound" vertical pattern 81 of pressure sensitive cohesive. The "inbound" vertical pattern 81 of pressure sensitive cohesive is preferably substantially linear.

In the alternative embodiment of the invention shown in FIG. 6B, the one or more elements 83' of a second vertical pattern 81' are disposed substantially centrally along the tear-off strip 58A between and the second side edge 51 and the second line of weakness and parallel to the first and second side edges 51 and 52.

In a further alternative embodiment, one or more elements 83' of a second vertical pattern 81' are outbound elements 83' disposed parallel to the first and second side edges 51 and 52 and immediately adjacent the second side edge 52.

Positioning one or more of the elements 82, 82' and 83, 83' of the first and the second vertical patterns 80, 80' and 81, 81', along with the length, width and/or shape of the elements 82, 82' and 83, 83', as described in further detail below, help to ensure that none of the elements 82, 82' and 83, 83 of the vertical patterns 80, 80, and 81, 81' along the first face 52 touch or overlap any of the patterns of cohesive disposed on the second face 54 of the intermediate 50. This is particularly advantageous when the intermediate 50 or the web 30 is formed into or is supplied in a roll or sheet form. The first and the second vertical patterns 80, 80' and 81, 81' on the first face 52 of each of the plurality of intermediates 50 comprising the web 30 do not touch or overlap with any patterns of pressure sensitive cohesive along the second face 54 to thereby help to ensure the integrity of the web 30 and the individual intermediates 50, as well as to employ the web 30 to supply the intermediates 50 to printing and/or other processing equipment and mechanisms.

As shown in FIGS. 6A-6B, the elements 82, 82' of the first vertical pattern 80, 80' are disposed along the tear-off strip 58A of the second and third panels 66 and 68 of the first face 52. Similarly, the elements 83, 83' of the second vertical pattern 81, 81' are disposed along the tear-off strip 58B of the second and third panels 66 and 68. Each element 82, 82' and 83, 83' disposed along the tear-off strip 58A and 58B of the second panel 66, respectively, is disposed and/or is sized to mate with a corresponding element 82, 82' and 83, 83' disposed along the tear-off strip 58A and 58B of the third panel 68 when the intermediate 50 is folded about the second fold line 59 to place the second panel 66 and the third panel 68 in face-to-face relation. The mated elements 82, 82' and 83, 83' are adhered or bonded together during processing of the intermediate 50.

In addition, in the preferred embodiment of the invention, the first and the second vertical patterns 80, 80' and 81, 81' of pressure sensitive cohesive on the first face 12 are sized, e.g., define a length, width and/or shape, such that when the intermediate 50 or the web 30 is formed into or is supplied as a roll form, the first and the second vertical patterns 80, 80' and 81, 81' along the first face 52 do not touch or overlap with any patterns of pressure sensitive cohesive on the second face 54.

More particularly, along with the positioning of one or more of the elements 82 and 83, the size, e.g., as defined by a length, width, and/or shape, of one or more of the elements 80, 80' and 82, 82' help to prevent each element 82, 82' and 83, 83' from touching or overlapping any of the patterns of cohesive along the second face 54. In the preferred embodiment of the invention one or more of the outbound and inbound elements 82 and 83 of the first and the second vertical patterns 80, 80' and 81, 81' respectively, defines a length $L_2$ (along a transverse dimension parallel to the first and second end edges 51 and 52) less than the length $L_1$ of the tear-off strips 58A and 58B.

In the preferred embodiment, the length $L_2$ of each element 82, 82 and 83, 83' respectively, is within a range of from about 1/32 inch to about 2/3 inch, and preferably from about 1/16 inch to about 1/4 inch, and most preferably about 1/8 inch.

With further reference to FIGS. 6A-6B, the intermediate 50, and each of the plurality of intermediates 50 of the web 30, further includes a first horizontal pattern 61 of pressure sensitive cohesive disposed along the first face 52 substantially parallel to the first and second end edges 56 and 58 and adjacent the first end edge 56. In addition, a second horizontal pattern 65 of pressure sensitive cohesive is disposed along the first face 52 substantially parallel to the first and second end edges 56 and 58 and adjacent and above the first fold line 53. Each of the first horizontal pattern 61 and the second horizontal pattern 65 may include, for instance, a substantially linear pattern and/or a plurality of strips, dots and/or other geometric shapes of cohesive. In the preferred embodiment, the first and the second horizontal patterns 61 and 65 include substantially linear patterns.

Each of the one or more elements 63 and 67 that collectively comprise the first horizontal pattern 61 and the second horizontal pattern 65, respectively, are positioned and/or sized, e.g., as defined by a length, width and/or shape, such that when the intermediate 50 is folded about the second fold line 59 to place the third panel 68 and the second panel 66 in face-to-face relation, each element 63 of the first horizontal pattern 61 mates with a corresponding element 67 of the second horizontal pattern 65 to permit the mated elements 63 and 67 to be adhered or bonded during processing of the intermediate 50 and to thereby adhere or bond the second and the third panels 66 and 68 of the first face 52 together.

As shown in FIGS. 6A-6B, a width $W_3$ (in a horizontal dimension parallel to the first and the second end edges 16 and 18) of each element 63 and 67 of the first horizontal pattern 61 and the second horizontal pattern 65, respectively, along the first face 52 is greater than a width $W_4$ (in a horizontal dimension parallel to the first and the second end edges 16 and 18) of spacing defined between two horizontally adjacent pairs of elements 63 and 67.

In addition, the width $W_3$ of each of the one or more elements 63 and 67 may be substantially the same width $W_3$ as other elements 63 and 67 of the respective horizontal patterns 61 and 65, or may have a different width $W_3$ from one or more of the other elements 63 and 67.

In the preferred embodiment of the invention, each of the elements 63 and 67 of the respective horizontal patterns 61 and 67 has a width $W_3$ that is greater than a width $W_4$ of the spacing defined between horizontally adjacent pairs of elements 63 and 67. The width $W_3$ of the elements 63 and 67 helps to dispose a larger portion of cohesive along the first face 52 to thereby help to increase or maximize the security of the first face 52, especially if the first face 52 constitutes an imaged face of the intermediate 50. In particular, as mentioned above, security of the intermediate 50 is desirable if the imaged first face 52 includes personal and/or confidential information.

With reference to FIG. 7, the intermediate 50, and each of the plurality of intermediates 50 of the web 30, further includes on the second or back face 54 at least one vertical pattern 90 of pressure sensitive cohesive disposed along an area defined between the first and the second lines of weakness 55 and 57 and parallel to the first and the second side edges 51 and 52. In the preferred embodiment, the at least one vertical pattern 90 is disposed longitudinally along the area of the first panel 70 and the second panel 72 of the second face 54 when the vertical patterns 80 and 81 and the horizontal patterns 61 and 65 of cohesive on the first face 52 are disposed along the second and third panels 66 and 68 as shown in FIGS. 6A-6B.

As shown in FIG. 7, the second face 54 may further include one or more vertical patterns 92, 94, 96, 98 on the second face 54 disposed longitudinally along the area of the first panel 70 and the second panel 72 defined between the first and the second lines of weakness 55 and 57. Whether one or more of the vertical patterns 90, 92, 94, 96, 98 is used depends on the application in which the intermediate 50 or the web 30 is being used, the information and other indices printed or otherwise disposed along the panels 70, 72 and 74, and/or the positioning of any attachments contained within the intermediate 50 when the intermediate 50 is formed into a Z-fold mailer.

With further reference to FIGS. 6A-6B and 7, a surface area 64' of the first panel 64 of the first face 52 of the intermediate 50, and of each of the plurality of intermediates 50 of the web 30, serves as a front of an outgoing envelope where the intermediate 50 is Z-folded. Address, postage and/or other information and indicia are disposed along the front 64' of the envelope. In this case, a surface area 74' of the third panel 74 of the second face 54 serves as a back of the outgoing envelope.

Where the Z-folded intermediate 50 is sealed each of the corresponding elements of the one or more vertical patterns 90, 92, 94, 96, 98, respectively, disposed along the first and the second panels 70 and 72 mate, as a result of folding the intermediate 50 about the first fold line 53 to place the first and the second panels 70 and 72 in face-to-face relation. The mated elements help to form a secure or permanent bond that helps to securely bind an attachment, e.g., contained within the Z-folded intermediate 50 and/or adhered to one or more of the panels 66 and 68, to the outgoing envelope. This helps to prevent the envelope from being detached from the attachment to thereby help to ensure address and postage information are permanently affixed to the Z-fold mailer.

Disposing one or more vertical patterns 90, 92, 94, 96, 98 of pressure sensitive cohesive on the second face 52 between the first and the second lines of weakness 55 and 57 helps to define each tear-off strip 58A and 58B with a narrow length $L_1$, e.g., of from about ⅛ inch to about ⅝ inch, and preferably from about ¼ inch to about ½ inch, and most preferably about ⅜ inch. The narrow length $L_1$ of the tear-off strips 58A and 58B helps to ensure that an imaging area of each face 52 and 54 defined between the first and the second lines of weakness 55 and 57 is increased or maximized.

In addition, the plurality of vertical patterns 90, 92, 94, 96, 98 of pressure sensitive cohesive on the second face 54 helps to prevent "dishing" during winding or rewinding of the web 30 in roll form. Typically during winding and rewinding operations, pressure along the entire roll form of the web 30 is substantially along the tear-off strips 58A and 58B that include the vertical patterns 80, 80' and 81, 81' of pressure sensitive cohesive. The vertical patterns 80, 80' and 81, 81' constitute a relatively thicker portion of the web 30 than can build up quickly when the web 30 is continuously wound and the thicker portions are disposed on other thicker portions of the roll form. This may cause the roll form to "dish", or, in other words, to shift to the left or the right between winds of the web 30. In addition, in the event of any sideways tension along the web 30 in roll form, e.g., such as when the roll form is on a skid during shipping, "pressure points", or the vertical patterns 80, 80' and 81, 81' of pressure sensitive cohesive, created during winding may cause the roll form to "dish" along its edge or shift to the left or right. Eliminating vertical patterns of pressure sensitive cohesive along the tear-off strips 58A and 58B of the second face 54 of the intermediate 50 helps to reduce or eliminate problems associated with dishing. In addition, providing multiple vertical patterns 90, 92, 94, 96, 98 of pressure sensitive cohesive on the second face 52 helps to increase the number of "pressure points" created during winding to help to enable the roll form to be wound tighter and to help to reduce or eliminate problems associated with dishing.

Further, the multiple vertical patterns 90, 92, 94, 96, 98 of pressure sensitive cohesive on the second face 52 help to reduce or eliminate the need for horizontal patterns of pressure sensitive cohesive along the second face 52.

Figure 8:
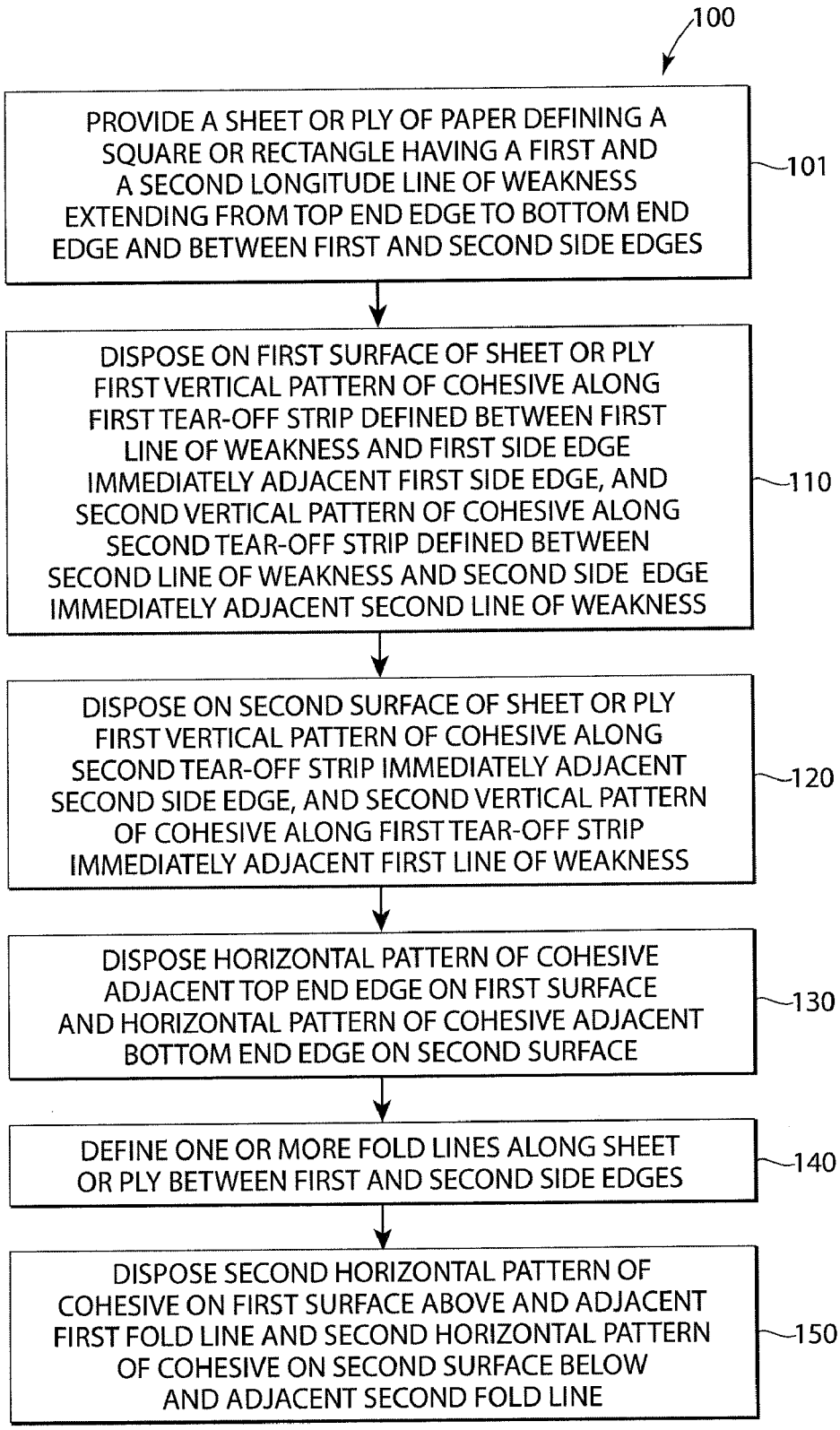
FIG. 8 is a flow diagram of another aspect of the invention providing a method of forming an intermediate form.

With reference to FIG. 8, in another aspect of the invention, a method 100 of forming an intermediate form for use in producing a Z-fold or an eccentric Z-fold business type mailer from stacked intermediates or intermediates in roll form is provided and includes the stages shown. The method 100, however, is exemplary only and not limiting. The method can be altered, e.g., by having stages added, removed, or rearranged.

At stage 101, a single sheet or ply 10 of paper is provided that defines a square or a rectangular configuration, the single sheet or ply having defined thereon a first and a second longitudinal line of weakness 15 and 17 extending from a top end edge 16 to a bottom end edge 18 and disposed between a first and a second side edge 20 and 22 that is disposed substantially perpendicular to the top and the bottom end edges, with a first tear-off strip 38A defined between the first line of weakness 15 and the first side edge 20 and a second tear-off strip 38B defined between the second line of weakness 17 and the second side edge 22.

At stage 110, a first plurality of vertical patterns of cohesive 19 and 21 is disposed on a first surface 12 of the sheet or ply along the first and the second tear-off strips 38A and 38B with a first vertical pattern of cohesive 19 disposed along the first tear-off strip 38A immediately adjacent to the first side edge 20 and a second vertical pattern of cohesive 21 disposed along the second tear-off strip 38B immediately adjacent the second line of weakness 17.

At stage 120, a second plurality of vertical patterns of cohesive is disposed on a second surface 14 of the sheet or ply 10 along the first and the second tear-off strips 38A and 38B with a first vertical pattern of cohesive 27 disposed along the second tear-off strip 39B immediately adjacent to the second side edge 22 and a second vertical pattern of cohesive 31 disposed along the first tear-off strip 38A immediately adjacent the first line of weakness 15.

At stage 130, a third plurality of horizontal pattern of cohesive is disposed on the first and the second surfaces 12 and 14 with at least a first horizontal pattern of cohesive 37 disposed on the first surface 12 adjacent the top end edge 16 and at least a first horizontal pattern of cohesive 43 disposed on the second surface 14 adjacent the bottom end edge 18. The first cohesive pattern 43 on the second surface 14 includes one or more cohesive elements 47 each having a width $W_5$ (in a transverse dimension parallel to the top and the bottom end edges 16 and 18) less than a width $W_6$ of the spacing between one or more pairs of adjacent elements 47, and less than a width $W_3$ (in a transverse dimension parallel to the top and the bottom end edges 16 and 18) of one or more cohesive elements 41 of the first horizontal pattern of cohesive 37 on the first surface 12.

Optionally, the method 100 may further include additional stages as recited below.

At stage 140, the sheet or ply 10 is configured with one or more fold lines, such that a first fold line 11 is disposed on the sheet or ply 10 to define a first panel 24 between the bottom end edge 18 and the first fold line 11, and a second fold line 13 is disposed on the sheet or ply 10 spaced from the first fold line 11 to define a second panel 26 between the first and the second fold lines 11 and 13 and a third panel 28 between the second fold line 13 and the top end edge 16. The first and the second fold lines 11 and 13 are substantially parallel to one another and the top and the bottom end edges 16 and 18.

At stage 150, a fourth plurality of horizontal patterns of cohesive is disposed on the first and the second surfaces 12 and 14 with at least a second horizontal pattern of cohesive 35 disposed on the first surface 12 above and adjacent the first fold line 11 and at least a second horizontal pattern of cohesive 45 on the second surface 14 below and adjacent the second fold line 13.

Having thus described at least one illustrative embodiment of the invention, various alterations, modifications and improvements will readily occur to those skilled in the art. Such alterations, modifications and improvements are intended to be within the scope and spirit of the invention. Accordingly, the foregoing description is by way of example only and is not intended as limiting.

What is claimed is:

1. An intermediate form for forming a Z-fold business mailer comprising:

a single sheet of paper having a top end edge, a bottom end edge opposite and parallel to the top end edge, a first side edge, and a second side edge opposite and parallel to the first side edge, the edges defining a square or a rectangular configuration;

a first and a second line of weakness extending longitudinally from the top end edge to the bottom end edge and being substantially parallel to the side edges, the first line of weakness being closest to the first side edge, a first tear-off strip defined between the first line of weakness and the first side edge, and the second line of weakness being closest to the second side edge, a second tear-off strip defined between the second line of weakness and the second side edge;

a first fold line extending horizontally between the first and the second side edges to define a first panel between the bottom end edge and the first fold line, and a second fold line extending horizontally between the first and the second side edges to define a second panel between the first and the second fold lines and to define a third panel between the top end edge and the second fold line;

only a first vertical linear pattern of cohesive disposed on a first surface of the sheet extending from the top end edge to the first fold line along the first tear-off strip of the third and second panels immediately adjacent the first side edge, and only a second vertical linear pattern of cohesive disposed on the first surface of the sheet extending from the top end edge to the first fold line along the second tear-off strip of the third and second panels immediately adjacent the second line of weakness;

a third vertical linear pattern of cohesive disposed on a second surface of the sheet extending from the second fold line to the bottom end edge along the second tear-off strip of the second and first panels immediately adjacent the second side edge, and a fourth vertical linear pattern of cohesive disposed on the second surface of the sheet extending from the second fold line to the bottom end edge along the first tear-off strip of the second and first panels immediately adjacent the first line of weakness;

a first and a second horizontal pattern of cohesive disposed along the first surface, the first horizontal pattern disposed adjacent the top end edge and the second horizontal pattern disposed above the first fold line;

a third and a fourth horizontal pattern of cohesive disposed along the second surface, the third horizontal pattern disposed immediately adjacent the bottom end edge and the fourth horizontal pattern disposed below the second fold line; and the first and the second vertical linear patterns of cohesive being sized and disposed along the first surface, and the third and the fourth vertical linear patterns of cohesive being sized and disposed along the second surface such that, when the sheet is stacked upon the first surface of a second identical intermediate form, the fourth and the third vertical patterns along the second surface do not touch or overlap the first and the second vertical patterns, respectively, along the first surface of the second intermediate form.

2. The intermediate form of claim 1, wherein the first and the second vertical linear patterns being disposed and configured such that, when the sheet is folded about the second fold line to place the third and the second panels in face-to-face relation, at least a portion of the first pattern disposed along the first tear-off strip of the third panel aligns and mates with at least a portion of the first pattern disposed along the first tear-off strip of the second panel, and at least a portion of the second pattern disposed along the second tear-off strip of the third panel aligns and mates with at least a portion of the second pattern disposed along the second tear-off strip of the second panel.

3. The intermediate form of claim 2, wherein the first and the second vertical linear pattern being defined by one or more individual cohesive elements and wherein each cohesive element has a width, along a vertical dimension of the sheet parallel to the side edges, that is greater than or equal to a width, along a vertical dimension of the sheet parallel to the side edges, of each space defined between vertically adjacent cohesive elements.

4. The intermediate form of claim 1, wherein the third and the fourth vertical linear patterns being disposed and configured such that, when the sheet is folded about the first fold line to place the second and the first panels in face-to-face relation, at least a portion of the third pattern disposed along the second tear-off strip of the second panel aligns and mates with at least a portion of the third pattern disposed along the second tear-off strip of the first panel, and at least a portion of the fourth pattern disposed along the first tear-off strip of the second panel aligns and mates with at least a portion of the fourth pattern disposed along the first tear-off strip of the first panel.

5. The intermediate form of claim 4, wherein the third and the fourth vertical linear pattern being defined by one or more individual cohesive elements and wherein each cohesive element has a width, along a vertical dimension of the sheet parallel to the side edges, that is greater than or equal to a width, along a vertical dimension of the sheet parallel to the side edges, of each space defined between vertically adjacent cohesive elements.

6. The intermediate form of claim 1, wherein the first and the second horizontal pattern of cohesive being disposed and configured such that, when the sheet is folded about the second fold line, at least a portion of the first horizontal pattern aligns and mates with at least a portion of the second horizontal pattern.

7. The intermediate form of claim 6, wherein the first and the second horizontal pattern of cohesive being defined by one or more individual cohesive elements and wherein each cohesive element has a width, along a horizontal dimension of the sheet parallel to the end edges, that is less than or equal to a width, along a horizontal dimension of the sheet parallel to the end edges, of each space defined between horizontally adjacent cohesive elements.

8. The intermediate form of claim 1, wherein the third and the fourth horizontal pattern of cohesive being disposed and configured such that, when the sheet is folded about the first fold line, at least a portion of the third horizontal pattern aligns and mates with at least a portion of the fourth horizontal pattern.

9. The intermediate form of claim 8, wherein the third and the fourth horizontal pattern of cohesive being defined by one or more individual cohesive elements and wherein each cohesive element has a width, along a horizontal dimension of the sheet parallel to the end edges, that is less than or equal to a width, along a horizontal dimension of the sheet parallel to the end edges, of each space defined between horizontally adjacent cohesive elements.

10. The intermediate of claim 1, wherein the first, the second and the third panels defined in the sheet by the first and the second fold lines have substantially equal dimensions.

11. The intermediate of claim 1, wherein the first and the second panel defined in the sheet by the first and the second fold lines have substantially equal dimensions and the third panel has different dimensions than the first and the second panels.

12. The intermediate of claim 1, wherein a length of each of the first and the second tear-off strips along a transverse dimension parallel to the top and bottom end edges includes a range of from about ¼ inch to about ¾ inch.

13. A roll of multiple intermediate forms for forming multiple Z-fold business mailers comprising:

a web or sheet of paper defining a multiple of intermediate forms, each intermediate form being defined by a first line of weakness disposed between the intermediate form and a first adjacent intermediate form and a second opposite line of weakness disposed between the intermediate form and a second adjacent intermediate form, the first and the second horizontal lines of weakness configured to separate the intermediate form from the first and the second adjacent intermediate forms;

the intermediate form comprising:

a portion of the web or sheet defining a top end edge, a bottom end edge opposite and parallel to the top end edge, a first side edge, and a second side edge opposite and parallel to the first side edge, the edges defining a square or a rectangular configuration;

a first and a second line of weakness extending longitudinally from the top end edge to the bottom end edge and being substantially parallel to the side edges, the first line of weakness being closest to the first side edge, a first tear-off strip defined between the first line of weakness and the first side edge, and the second line of weakness being closest to the second side edge, a second tear-off strip defined between the second line of weakness and the second side edge;

a first fold line extending horizontally between the first and the second side edges to define a first panel between the bottom end edge and the first fold line, and a second fold line extending horizontally between the first and the second side edges to define a second panel between the first and the second fold lines and to define a third panel between the top end edge and the second fold line;

only a first and only a second vertical linear pattern of cohesive disposed on a first surface of the intermediate form extending from the top end edge to the first fold line along the first and the second tear-off strips, respectively, of the third and second panels, the first vertical linear pattern being disposed immediately adjacent the first side edge, and the second vertical linear pattern being disposed immediately adjacent the second line of weakness;

a third and a fourth vertical linear pattern of cohesive disposed on a second surface of the intermediate form extending from the second fold line to the bottom end edge along the second and the first tear-off strips, respectively, of the second and first panels, the third vertical linear pattern being disposed immediately adjacent the second side edge, and the fourth vertical being disposed immediately adjacent the first line of weakness;

a first and a second horizontal pattern of cohesive disposed along the first surface, the first horizontal pattern disposed adjacent the top end edge and the second horizontal pattern disposed adjacent and above the first fold line;

a third and a fourth horizontal pattern of cohesive disposed along the second surface, the third horizontal pattern disposed adjacent the bottom end edge and the fourth horizontal pattern disposed adjacent and below the second fold line; and the first and the second vertical linear patterns of cohesive being sized and disposed along the first surface, and the third and the fourth vertical linear patterns of cohesive being sized and disposed along the second surface such that, when the web or sheet of multiple intermediate forms is configured as a roll, the first and the fourth vertical patterns do not touch or overlap one another along the first tear-off strip and the second and the third vertical patterns do not touch or overlap one another along the second tear-off strip.

14. An intermediate form for forming a Z-fold business mailer comprising:

a sheet of paper defining a square or a rectangular configuration having a first surface and a second surface, the sheet including a top end edge and a bottom end edge opposite and parallel to the top end edge, and a first side edge and a second side edge opposite and parallel to the first side edge, the first and the second side edges being substantially perpendicular to the top and the bottom end edges;

a first and a second line of weakness extending from the top end edge to the bottom end edge, the first and the second lines of weakness being substantially parallel to the first and the second side edges, the first line of weakness disposed closest to the first side edge to define a first tear-off strip therebetween and the second line of weakness disposed closest to the second side edge to define a second tear-off strip therebetween;

a first fold line extending horizontally between the first and the second side edges defining a first panel between the first fold line and the bottom end edge, and a second fold line extending horizontally between the first and the second side edges defining a second panel between the first and the second fold lines and a third panel between the second fold line and the top end edge;

only a first and only a second vertical linear pattern of cohesive disposed on a first surface of the sheet extending from the top end edge to the first fold line along the first and the second tear-off strips, respectively, of the third and second panels, the first vertical linear pattern being disposed immediately adjacent the first side edge, and the second vertical linear pattern being disposed immediately adjacent the second line of weakness;

the first and the second vertical linear patterns being disposed and configured such that, when the sheet is folded about the second fold line to place the third and the second panels in face-to-face relation, at least a portion of the first pattern disposed along the first tear-off strip of the third panel aligns and mates with at least a portion of the first pattern disposed along the first tear-off strip of the second panel, and at least a portion of the second pattern disposed along the second tear-off strip of the third panel aligns and mates with at least a portion of the second pattern disposed along the second tear-off strip of the second panel;

a third and a fourth vertical linear pattern of cohesive disposed on a second surface of the sheet extending from the second fold line to the bottom end edge along the second and the first tear-off strips, respectively, of the second and first panels, the third vertical linear pattern being disposed immediately adjacent the second side edge, and the fourth vertical being disposed immediately adjacent the first line of weakness;

the third and the fourth vertical linear patterns being disposed and configured such that, when the sheet is folded about the first fold line to place the second and the first panels in face-to-face relation, at least a portion of the third pattern disposed along the second tear-off strip of the second panel aligns and mates with at least a portion of the third pattern disposed along the second tear-off strip of the first panel, and at least a portion of the fourth pattern disposed along the first tear-off strip of the second panel aligns and mates with at least a portion of the fourth pattern disposed along the first tear-off strip of the first panel;

a first horizontal pattern of cohesive disposed along the first surface adjacent the top end edge, and a second horizontal pattern of cohesive disposed along the first surface adjacent and above the first fold line, the first and the second horizontal patterns being substantially parallel to the top and the bottom end edges; and a third horizontal pattern of cohesive disposed along the second surface adjacent and below the second fold line, and a fourth horizontal pattern of cohesive disposed along the second surface adjacent the bottom end edge, the third and the second horizontal patterns being substantially parallel to the top and the bottom end edges.

15. The intermediate of claim 14, wherein a length of each of the first and the second tear-off strips along a transverse dimension parallel to the top and bottom end edges includes a range of from about ¼ inch to about ¾ inch.

16. An intermediate form for forming a Z-fold business mailer comprising:

a single sheet of paper having a top end edge, a bottom end edge opposite and parallel to the top end edge, a first side edge, and a second side edge opposite and parallel to the first side edge, the edges defining a square or a rectangular configuration;

a first and a second line of weakness extending longitudinally from the top end edge to the bottom end edge and being substantially parallel to the side edges, the first line of weakness being closest to the first side edge, a first tear-off strip defined between the first line of weakness and the first side edge, and the second line of weakness being closest to the second side edge, a second tear-off strip defined between the second line of weakness and the second side edge;

a first fold line extending horizontally between the first and the second side edges to define a first panel between the bottom end edge and the first fold line, and a second fold line extending horizontally between the first and the second side edges to define a second panel between the first and the second fold lines and to define a third panel between the top end edge and the second fold line;

only a first vertical linear pattern of cohesive disposed on a first surface of the sheet extending from the top end edge to the first fold line along the first tear-off strip of the third and second panels, and only a second vertical linear pattern of cohesive disposed on the first surface of the sheet extending from the top end edge to the first fold line along the second tear-off strip of the third and second panels immediately;

at least a third vertical linear pattern of cohesive disposed on a second surface of the sheet extending from the second fold line to the bottom end edge along an area defined between the first and the second line of weakness; and a first horizontal pattern of cohesive disposed along the first surface adjacent the top end edge, and a second horizontal pattern of cohesive disposed along the first surface adjacent and above the first fold line, the first and the second horizontal patterns being substantially parallel to the top and the bottom end edges, wherein the sheet is folded about the second fold line to dispose the third and the second panels in face-to-face relation along the first surface, and folded about the first fold line to dispose the first and the second panels in face-to-face relation along the second surface to form a Z-fold business mailer.

17. The intermediate form of claim 16, wherein the first vertical linear pattern of cohesive disposed along the first tear-off strip of the third and second panels is disposed immediately adjacent the first side edge, and the second vertical linear pattern of cohesive disposed along the second tear-off strip of the third and second panels is disposed immediately adjacent the second line of weakness.

18. The intermediate form of claim 16, wherein the first and the second vertical linear patterns of cohesive disposed along the first and the second tear-off strips, respectively, of the third and second panels are disposed substantially centrally between the side edges and the lines of weakness.

19. The intermediate of claim 16, wherein the at least third vertical linear pattern of cohesive disposed along the second surface between the second fold line and the bottom end edge includes a plurality of linear patterns of cohesive.

20. The intermediate of claim 16, wherein the first, the second and the third panels defined in the sheet by the first and the second fold lines have substantially equal dimensions.

21. The intermediate of claim 16, wherein the first and the second panels defined in the sheet by the first and the second fold lines have substantially equal dimensions and the third panel has different dimensions from the first and the second panels.

22. The intermediate of claim 16, wherein a length of each of the first and the second tear-off strips along a transverse dimension parallel to the top and the bottom end edges includes a range of from about ⅛ inch to about ¾ inch.

* * * * *